US006942413B2

(12) United States Patent
Lane

(10) Patent No.: US 6,942,413 B2
(45) Date of Patent: Sep. 13, 2005

(54) DISC MANAGEMENT SYSTEM

(76) Inventor: Bradley P. Lane, P.O. Box 968, Sunset Beach, CA (US) 90742

( * ) Notice: Subject to any disclaimer, the term of this patent is extended or adjusted under 35 U.S.C. 154(b) by 230 days.

(21) Appl. No.: 09/982,365

(22) Filed: Oct. 17, 2001

(65) Prior Publication Data

US 2003/0072604 A1 Apr. 17, 2003

(51) Int. Cl.[7] ..... B42F 13/00

(52) U.S. Cl. ..... 402/73; 402/15; 402/18; 402/7; 402/70; 402/75; 402/79; 402/78; 402/76; 402/77; 281/15.1; 281/21.1; 281/28; 281/29; 281/31; 281/34; 281/40; 281/45; 206/307; 206/308.1; 206/313; 283/36; 283/37; 283/38; 283/39; 283/40; 283/41

(58) Field of Search ..... 402/7, 15, 18, 402/70, 73, 75, 76, 77, 78, 79, 80 R; 281/15.1, 28, 21.1, 29, 31, 34, 40, 45; 206/307, 313, 308.1, 472, 473; 283/36–41

(56) References Cited

U.S. PATENT DOCUMENTS

| | | | | | |
|---|---|---|---|---|---|
| 3,645,637 | A | * | 2/1972 | Gustafson | 402/15 |
| 3,797,152 | A | * | 3/1974 | Brandt | 40/774 |
| 3,837,104 | A | * | 9/1974 | Brotschi | 40/404 |
| 4,676,374 | A | * | 6/1987 | Wilkins | 206/308.3 |
| 4,696,491 | A | * | 9/1987 | Stenger | 283/37 |
| 4,805,039 | A | * | 2/1989 | Otake et al. | 386/52 |
| 4,850,731 | A | | 7/1989 | Youngs | |
| 4,934,738 | A | * | 6/1990 | Colonna | 281/28 |
| 4,966,285 | A | * | 10/1990 | Otake et al. | 206/455 |
| 5,066,046 | A | * | 11/1991 | Hoopingarner | 283/70 |
| 5,136,562 | A | * | 8/1992 | Staar | 369/30.53 |
| D333,610 | S | | 3/1993 | Oshry et al. | |
| 5,290,118 | A | * | 3/1994 | Ozeki | 402/79 |
| 5,501,540 | A | * | 3/1996 | Ho | 402/73 |
| 5,555,977 | A | * | 9/1996 | Oshry et al. | 206/308.1 |
| 5,556,683 | A | * | 9/1996 | Ranalli | 428/76 |
| 5,588,528 | A | * | 12/1996 | Ozeki | 206/308.1 |
| 5,595,293 | A | * | 1/1997 | Miller | 206/308.1 |
| 5,620,271 | A | | 4/1997 | Bergh et al. | |
| 5,692,607 | A | * | 12/1997 | Brosmith et al. | 206/308.1 |
| 5,713,683 | A | | 2/1998 | Bergh et al. | |
| 5,727,201 | A | | 3/1998 | Burke | |
| 5,735,396 | A | * | 4/1998 | Condorodis | 206/308.1 |
| D403,915 | S | | 1/1999 | Temple et al. | |
| D411,402 | S | * | 6/1999 | Udwin et al. | D6/626 |
| 5,908,259 | A | * | 6/1999 | Johnson | 402/79 |
| 5,909,687 | A | * | 6/1999 | Tapper | 707/104.1 |
| 5,996,785 | A | * | 12/1999 | Palmer et al. | 206/308.1 |
| 6,135,662 | A | * | 10/2000 | Bakke et al. | 402/73 |
| 6,139,210 | A | * | 10/2000 | Nelson et al. | 402/79 |
| 6,186,320 | B1 | | 2/2001 | Drew | |
| 6,250,460 | B1 | * | 6/2001 | Dottel | 206/308.1 |
| 6,265,043 | B1 | * | 7/2001 | Vinyard et al. | 428/40.1 |

(Continued)

FOREIGN PATENT DOCUMENTS

| | | | | |
|---|---|---|---|---|
| EP | 479556 A1 | * | 4/1992 | G11B/33/04 |

OTHER PUBLICATIONS

PCT/US02/32934–International Search Report dated Apr. 29, 2003.

*Primary Examiner*—A. L. Wellington
*Assistant Examiner*—Mark Henderson
(74) *Attorney, Agent, or Firm*—Fulwider Patton Lee & Utecht, LLP.

(57) ABSTRACT

An optical storage media management system and process for storing and organizing a relatively large collection of optical discs in the form of a display binder with a plurality of display sheets including associated indicia matching a positional identifier indicating the location of the disc. In one embodiment, the binder is used in conjunction with a table of contents indicating the position of individual optical discs in relation to the binder contents and a centralized database for storing optical disc information in a categorized format in cooperation with a computerized table of contents generator for generating the table of contents for the binder.

14 Claims, 16 Drawing Sheets

U.S. PATENT DOCUMENTS 6,282,826 B1 * 9/2001 Richards ..... 40/775
6,316,081 B1 * 11/2001 Nelson et al. ..... 428/195
6,325,207 B2 * 12/2001 Drew ..... 206/308.1
6,390,714 B1 * 5/2002 Bradley et al. ..... 402/79
6,409,013 B1 * 6/2002 Eskandry ..... 206/308.1
6,450,535 B1 * 9/2002 Shafer ..... 281/38
6,632,042 B1 * 10/2003 Liener Chin et al. ..... 402/79
2002/0067037 A1 * 6/2002 Lo ..... 281/15.1
2002/0084200 A1 * 7/2002 Bergh et al. ..... 206/308.1
2002/0197098 A1 * 12/2002 Palmer ..... 402/79

* cited by examiner

FIG. 1
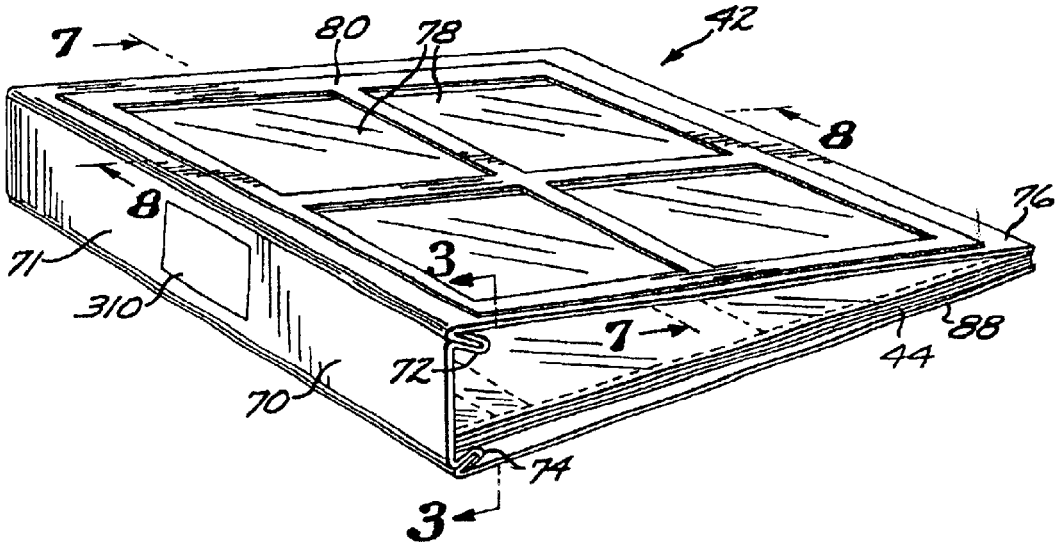
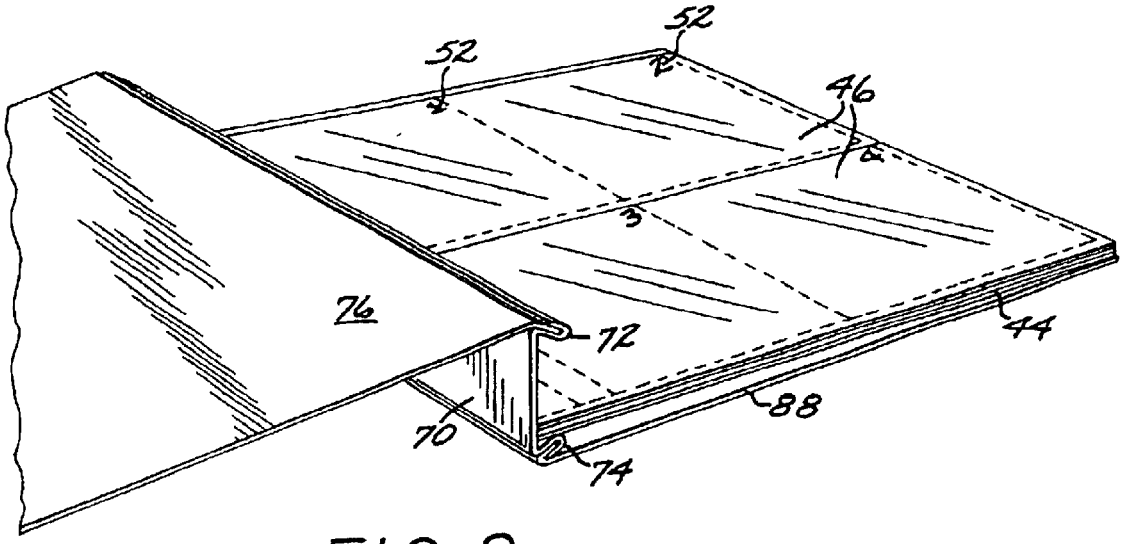
FIG. 2

FIG. 9
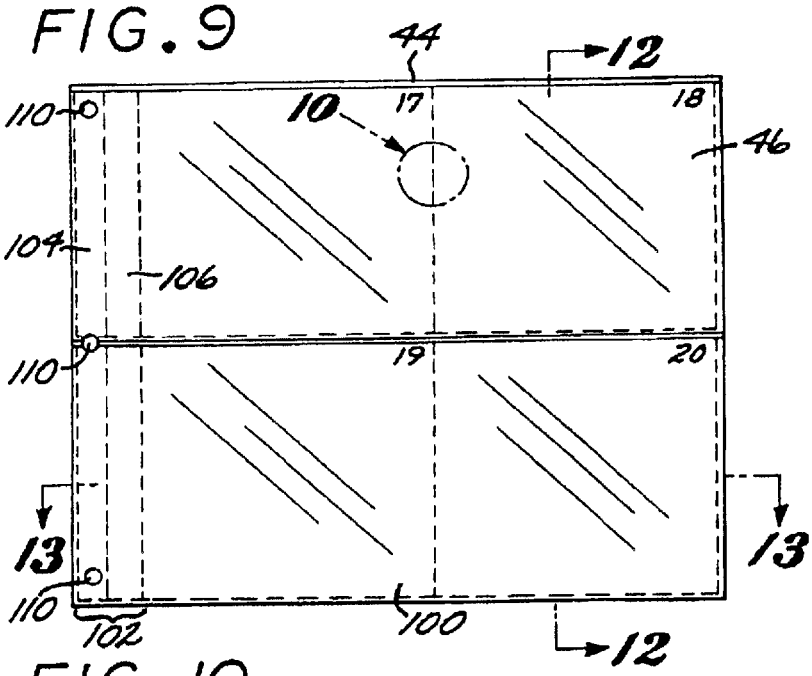
FIG. 12
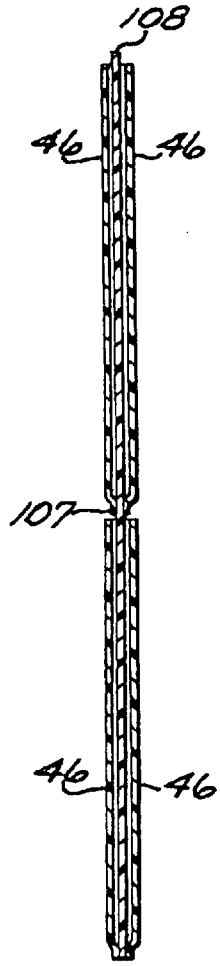
FIG. 10
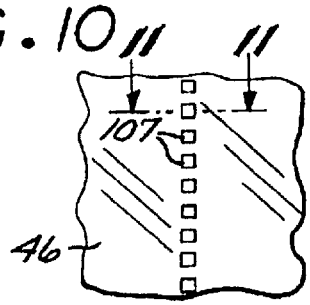
FIG. 11
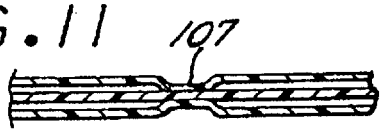
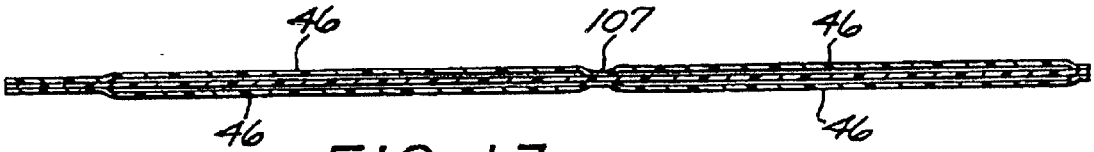
FIG. 13

DISC MANAGEMENT SYSTEM

BACKGROUND OF THE INVENTION

1. Field of the Invention

The invention relates generally to data management and more specifically, to indexing systems for optical disk storage media.

2. Description of the Prior Art

When purchased, musical compact discs (CDs) are generally packaged in jewel boxes which are typically rigid, thick plastic cases having a pivoting front cover and an internal mounting platform for receipt of the compact disc itself. Liner notes including information about the disc contents such as song titles and lyrics along with credits and cover artwork are then slid into the front cover with the artwork facing outward. A second liner is placed behind the mounting platform with its ends folded up to place one folded end along the spine of the jewel box indicating the title of the music CD. The compact disc itself is about four and three-quarters inches in diameter, thin, circular, and typically includes a printed side and an opposing optical data storage surface.

Due to their longevity and cost, compact disc owners tend to allow their CD collections to build up and thus storage and organization becomes an ever present problem. A frequent approach to organizing a large number of compact discs is to store them in a storage tower or rotating carousel. CDs are inserted into individual shelves and stacked on top of one another exposing only the spine portion of their respective jewel boxes to display the title of the CD. A CD may thus be identified by reading through the spines to select a desired CD. The jewel case may be removed and opened to remove the CD for playing in a conventional compact disc player or personal computer having a compact disc readable drive. Often the jewel case is left out of the tower until the user elects to replace the CD within the case and place the case and CD back into a tower slot. This method has proven unsatisfactory as the towers required to house a large collection of CDs must be of considerable size thus occupying a significant amount of space. Further, since there is no indexing system the user must undertake the tedious task of examining each individual CD case until the desired one is located. In effort to overcome this deficiency, often a user will organize the CD collection within the tower in some fashion such as alphabetical or even further using musical categories. This does not remove the problem of tower space and as the collection grows, a significant amount of shifting must take place as new CDs are introduced into the collection and must be stored according to the previously determined order.

While the introduction of thin-spine jewel boxes reduces the need for overall space, these thin-spine jewel boxes introduce a new problem because the spines are often narrow leaving little room for display of the title of the CD thus presenting a challenge to selecting the title desired, particularly in subdued lighting. Thus, the user is often forced to withdraw a number of CDs to expose their respective front covers for review until the CD is located.

Since jewel cases are not particularly useful after purchase and take up significant space, they are often discarded leaving only the liner notes and CD. Thus, other attempts have been made to provide a satisfactory storage means for the CDs and their associated liner notes. Two such proposed solutions may be found in U.S. Pat. Nos. 5,620,271 and 5,713,683, both to Bergh et al. These patents describe a three ring binder page for holding compact discs in two by two matrices forming rectangular sleeves defining individual pages and having a transparent front face and an opening along one edge. The sleeves are sized to receive a compact disc or its associated notes. Often a thumb notch is disposed along the open edge to facilitate retrieval of the disc. Along one edge of the binder sheet is a set of holes spaced apart to receive the rings of a binder. A user can flip the pages to locate and remove the desired CD to be inserted into a conventional CD player. While these two patents address an alternative storage scheme allowing a CD collector to do away with the jewel cases, they do not provide any particular organizational means and thus the collector is left with the tedium of leafing through individual pages to visually scan through the transparent front faces of the sleeves to locate the desired CD.

Thus, in addition to storing concerns created by a large number of CDs, the number of compact discs in one's collection may provide a daunting task in managing its organization for quick reference and retrieval. What is needed and heretofore unavailable is a disc management system for indexing and storing indices and other information relating to disc position within a storage medium as well as a method for generating such indices.

SUMMARY OF THE INVENTION

In accordance with a preferred embodiment of the present invention, a process for organizing a large number of CDs is disclosed herein and includes the steps of selecting a number of CDs to be organized and providing a binder trapping the respective edges of sheets formed with respective viewing pockets for insertion of respective CD related materials having graphics associated with the respective CDs to be viewed through the windows of respective viewing pockets.

Indicia is provided on the respective pockets to correlate them with respective CD storage slots which also include associated positional identifiers so that a user can store CDs and the associated material and can select the desired CD by referring to such associated material and the corresponding identifying indicia.

One embodiment of the present invention includes a table of contents generated using a centralized database including a number of CD titles and associated positional identifiers to create a CD index for insertion into viewing pockets of the binder for quick reference of the CD location.

Yet another embodiment of the present invention uses a disc management system incorporating a CD changer wherein the CDs are placed in unique slots in the CD changer and the positional identifier indicates the position of the CD within the changer.

In another embodiment, keyless entry is provided by providing a detector routine to read the contents of a CD and store the contents in the database.

Still yet another embodiment incorporates a search engine for searching an entire database catalog or a database library tailored to a particular user.

Other features which may be incorporated into the disc management system include the use of various viewing pocket configurations in a display binder for holding CD related materials.

Other features and advantages of the present invention will become more apparent from the following detailed description of the invention, when taken in conjunction with the accompanying exemplary drawings.

BRIEF DESCRIPTION OF THE DRAWINGS

FIG. 1 is a front perspective view a display binder in a closed configuration and incorporated into the preferred embodiment of the present disc management system;

FIG. 2 is a view as in FIG. 1 with the display binder in a open configuration;

FIG. 9 is a top elevational view of a display page incorporated into the display binder of the preferred embodiment of the present disc management system;

FIG. 10 is an expanded view taken from circle 10 in FIG. 9;

FIG. 11 is a cross sectional view, in enlarged scale, taken along lines 11—11 of FIG. 10;

FIG. 12 is a cross sectional view, in enlarged scale, taken along lines 12—12 of FIG. 9;

FIG. 13 is a cross sectional view, in enlarged scale, taken along lines 13—13 of FIG. 9;

DETAILED DESCRIPTION OF THE PREFERRED EMBODIMENT

Figure 3:
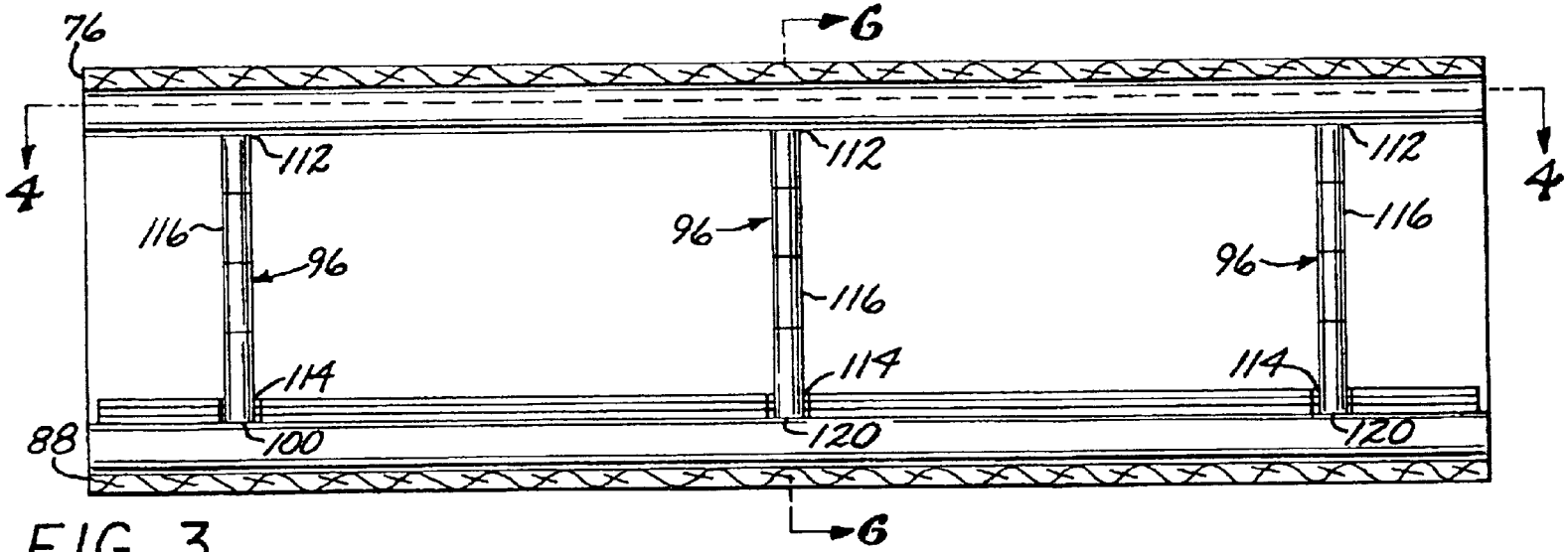
FIG. 3 is a cross sectional view, in enlarged scale, taken along lines 3—3 of FIG. 1.
Figure 4:
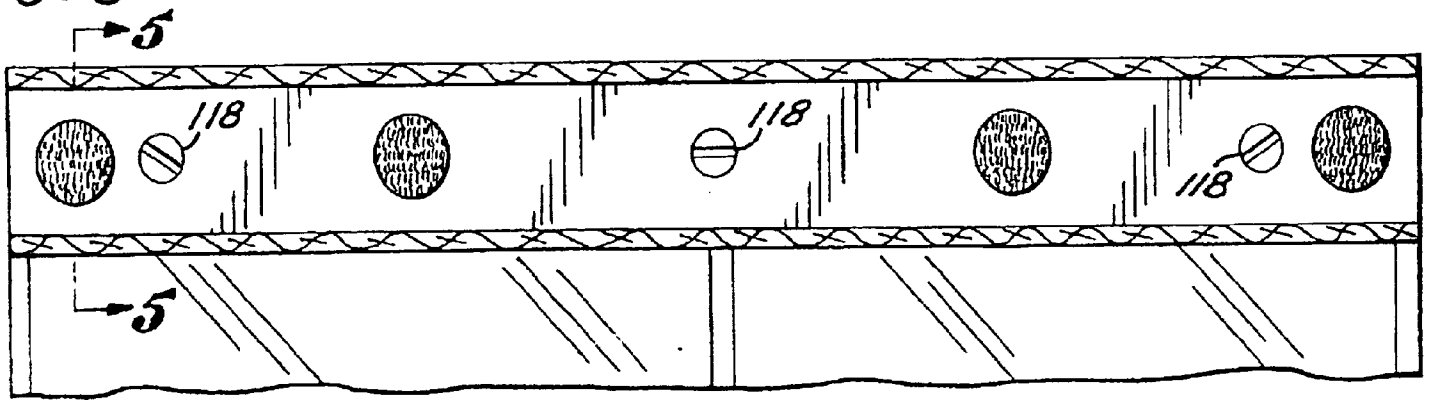
FIG. 4 is a cross sectional view taken along lines 4—4 of FIG. 3.
Figure 5:
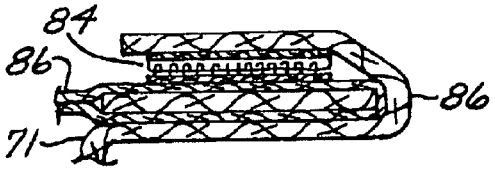
FIG. 5 is a cross sectional view, in enlarged scale, taken along lines 5—5 of FIG. 4.

Referring now to FIGS. 1–15, a disc management system, generally designated 40, is illustrated and provides a convenient tool for organizing large numbers of optical surface media such as compact discs (CD) and digital video discs (DVD) which contain music, software, or other data on their respective optical surfaces which will collectively be referred to as compact discs (CDs) throughout this application. Such disc management system 40 is especially useful when used in conjunction with a CD changer or other compact disc player wherein large numbers of CDs are stored within a number of positional slots in the changer and may be played as in a conventional CD player. However, it will be appreciated that the use of a changer is not a necessary component of the disc management system.

In general terms, the disc management system 40 includes a display binder, generally designated 42, for enclosing a plurality of looseleaf optical data disc storage pages 44 having at least one viewing pocket 46 for storing the contents retrieved from a discarded jewel case including the liner notes 48 and CD 50. Each viewing pocket includes an associated indicia 52 associated with a positional identifier 54 stored in a centralized database 58 listing the titles 60 of each CD and any associated track information 62 such as track title, length, and artist. A subset of the available titles 60 is selected and assigned a positional identifier 54 to generate a table of contents listing 64 from the database contents and positioned in at least one of the viewing pockets 46 to provide a quick reference guide to the location and contents of any CD incorporated into the system.

Figure 6:
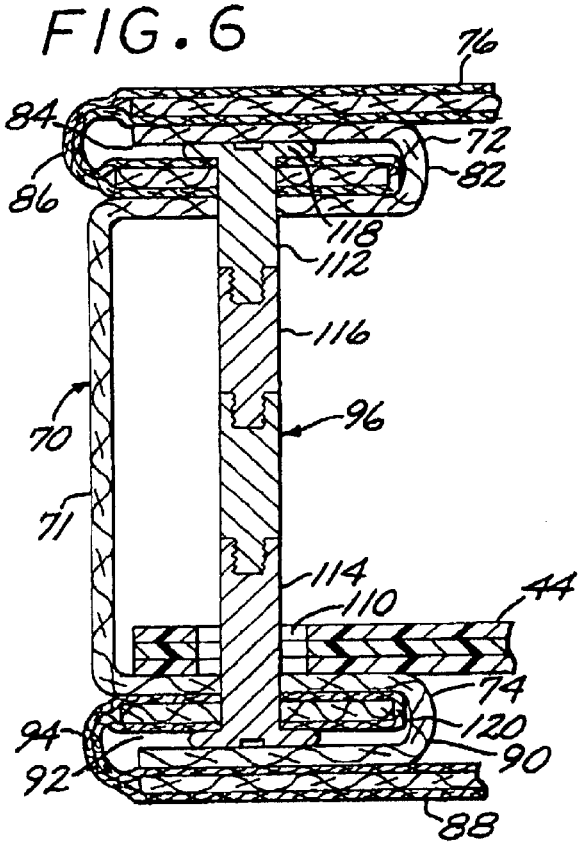
FIG. 6 is a cross sectional view, in enlarged scale, taken along lines 6—6 of FIG. 4.
Figure 7:
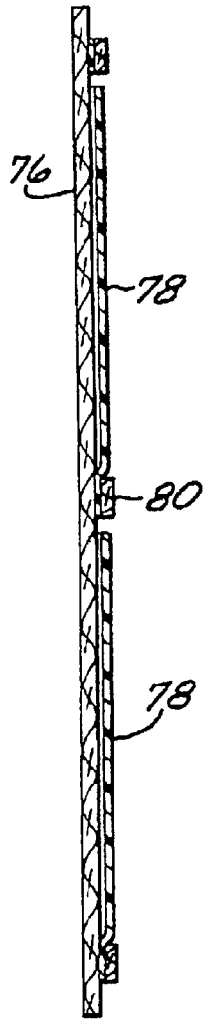
FIG. 7 is a cross sectional view, in enlarged scale, taken along lines 7—7 of FIG. 1.
Figure 8:
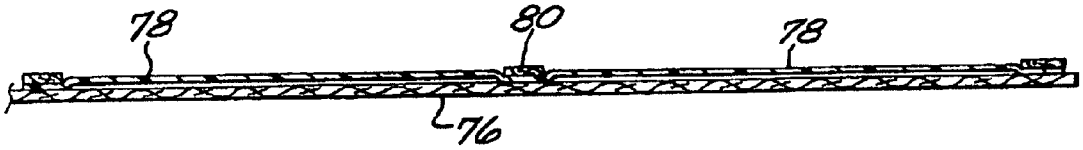
FIG. 8 is a cross sectional view, in enlarged scale, taken along lines 8—8 of FIG. 1.

Referring now to FIGS. 1–2, and 6, the display binder 42 includes a channel shaped spine 70 having a planar backing member 71 separating an upper flange 72 and a lower flange 74. Hingedly anchored to such upper flange 72 is a planar front cover 76 having four discrete top opening display transparent window pockets 78 recessed into a reinforced margin 80 and including a hook 82 at its innermost extremity. More specifically, as illustrated in FIG. 6, the upper flange 72 projects generally forwardly of the backing member and then doubles back on itself to form an upper retention recess 84 for receipt of the free end of the front cover hook 82. Positioned between the hook and the planar front cover is a flexible hinged portion 86 such that the front cover may be rotated up and away from the interior contents of the binder.

Using a similar construction, a planar back cover 88 having a hook 90 at its innermost extremity is hingedly attached to the lower flange 74. The lower flange also includes a flap projecting forwardly of the backing member 71 which double back onto itself to form a lower retention recess 92 for receipt of the free end of the back cover hook 90. As in the front cover, the back cover includes a flexible hinge 94 positioned between the back cover hook 90 and planar region of the back cover 88 facilitating relative rotation between the back cover and the backing member about the hinge. The back cover 88 may also include transparent window pockets (not shown) if desired. The front cover 76, spine 70, and back cover 88 are secured by a trio of removably attached posts 96 and cooperate to enclose the plurality of flexible compact disc content pages 44 which are suspended from the posts.

In the preferred embodiment, each looseleaf page or sheet 44 is divided into a viewing window section 100 and a hinge section 102 having an anchor strip 104 and adjacent gutter section 106 facilitating both the mounting and turning of the individual pages 44. The viewing window section 100 is divided into transparent quarter panels formed form a plastic material and openable along the top edge forming four top opening viewing pockets 46. Each pocket includes a frontal transparent viewing window 104 and is bordered on three of its sides by weld lines 107 where the plastic front surface is secured to a back lining 108. The back lining 108 of each pocket is preferably a non-woven material suitable for placement against the optical surface.

Each viewing pocket 46 includes an associated indicia 52 such as a numerical identifier or suitable code and which are selectively positioned in an ascending order throughout the respective pages in the binder. While the first page is typically left a table of contents section, the next sheets 34 may start at "1, 2, 3, . . . etc" until allow viewing pockets are labeled in a similar manner. The purpose of such associated indicia 52 will be further explained below.

To attach each of the looseleaf pages 44 to the binder 42, the anchor strip 104 includes three post receiving apertures 110 positioned respectively near the top edge of the sheet, the bottom edge of the sheet, and the midpoint of the sheet along its innermost edge. Each aperture 110 is dimensioned for receipt of one of the posts 96 to removably anchor the sheet to the binder. Positioned between the anchor strip 104 and window section 100 is a gutter section measuring about one inch in width facilitating flexion of the sheet 44 in relation to the spine when the pages are flipped. If desired, a thumb notch (not shown) extending from the top edge of each viewing panel 46 to its respective center point may be added the front panel of each quarter panel 46 to facilitate removal of a CD or liner within the quarter panel pocket 46.

Referring to FIG. 6, the posts 96 are constructed to include a top portion 112 separable from a bottom portion 114. As the binder size increases, additional intermediate posts 116 may be added to increase the number of sheets 44 that may be accommodated between the top flange 72 and bottom flange 74 which are relatively flexible in relation to the backing member 71 and may be expanded outwardly therefrom. The respective ends of the posts 112, 114 terminate in flattened heads 118, 120 which are positioned against the outer edges of the respective upper and lower hooks of the front and back covers thereby secured from the front cover 76 and back cover 88 to the spine 70 when fastened together. The posts 96 are preferably in the form of a threaded member having a head and threaded shank. The head portions 118, 120 are constructed with a tool receiving slot for turning.

The viewing pockets 46 are dimensioned to accommodate the material to be inserted therein such as a conventional compact disc 50 or DVD which by present standards is about 4-¾ inches in diameter or their associated liner notes 48. In the preferred embodiment for compact disc sized materials, the pockets are five inches along each edge. If mini-discs are being used, which typically have a diameter of 64 mm or around 2.5 inches, the pocket sizes are typically 2.5 inches to 3.0 inches square. Other suitable dimensions will occur to one of ordinary skill in the art. Conventional compact discs 50 have an aperture 122, a peripheral edge 124, a printed surface 126, and an opposing optical surface 128.

The voluminous quantities of CDs 50 residing in the collections of various collectors renders the task of composing a custom index extremely tedious. I have discovered this task can be achieved by the convenience and expedience of accessing any one of a number of different web sites maintaining comprehensive lists of popular titles in a centralized database 58 of available compact disc titles and tracks. Such a database may be employed to generate a table of contents 64 for placement in the display binder 42.

In practice, the present invention is embodied in an online web site (FIGS. 16–34) for use in conjunction with the display binder 42. In the preferred embodiment of the present disc management system 40, the database is accessible using conventional communication hardware and software such as a personal computer 130 having access to an Internet Service Provider (ISP) 132 or online service providing a communication path to the Internet 134. The personal computer is connected to a display monitor 136 and printer 138 for outputting the table of contents 64 and interacting with the online disc management system 40.

The web site is maintained by a web host computer 134 which is in communication with the database 58 and runs a resident disc management software application 136 using conventional programming techniques for controlling the interaction between the user while accessing and retrieving the contents of the database 58. The database 58 is primarily structured to store information in the fields including disc titles 60, track titles 62, along with a associated unique indicia 54.

When generated, the table of contents 64 or CD index includes such positional indicia 54 positioned adjacent a CD title 60 in numerical or other suitable order. Such table of contents 64 provides the pocket 46 position of the CD within the display binder 42 for quick referencing.

In practice, the interactivity between the user and the database is provided using a web site having active server pages as generally illustrated in FIGS. 16–34. In general terms, conventional browsing techniques are used to select hyperlinks to submit a request from the user's computer 130 to the web host computer 140 which maintains the web site and contains the web page information. The web host processor determines which active server web page to transmit back to the user's computer for display on the user's terminal 136 over the Internet 134. Using an iterative process the user stores retrievable information such as CD titles 60 and their associated positional identifiers 54 in the centralized database 58 and uses the menus provided by the web pages to create a CD index 64 for the binder 42 to organized the user's CD collection.

One such exemplary web site is illustrated in FIGS. 16–34. The exemplary web site includes a main disk management tools web page 200 as exemplified in FIG. 17. The main tool page 200 includes a number of disc management system tool links, generally designated 204 (FIG. 17) for accessing routines programmed into the disk management application 142 and the related web pages for maintaining compact disc and track information for the purpose of creating indices therefrom. However, the disc management system tools 204 are inactive until a successful login has been completed. Selection of any of the tool links 204 prior to a valid login results in a sign in menu 206 (FIG. 16) being transmitted to the user's display terminal 136 for display.

Figure 16:
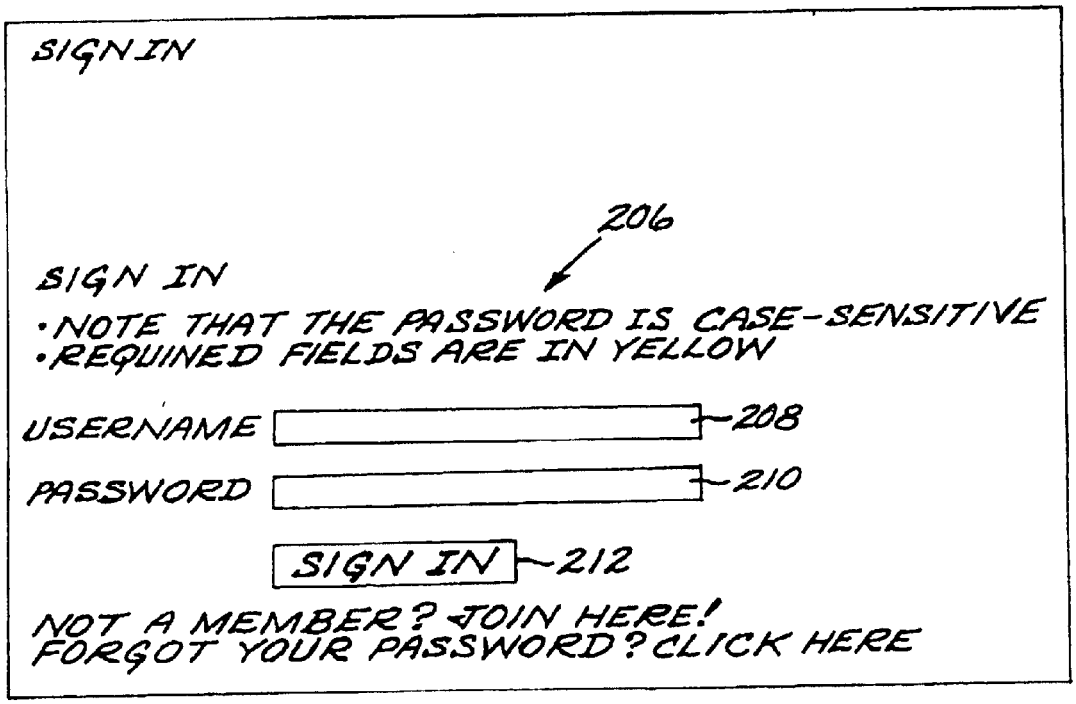
FIG. 16 is an exemplary sign in web page of the present disc management system.

With continued reference to FIG. 16, the sign in menu 206 includes a username text entry field 208, a password text entry field 210, and a sign in submission button 212. The unique userid or user name input into the username field 208 on the sign in menu 206 is assigned to each user and stored within the database 58 in a unique user library whereby select database contents are linked to the unique userid to tailor the database to an individual. A successful sign in again presents the user with the disk management tools page 200 (FIG. 17) with the now active links 204 including a List my CDs link 214, an Add a CD link 216, an Add a Track link 218, Add a Category link 219, a List Tracks on a CD link 220, a Print the Contents of a CD link 222, a Print Index Cards link 224, a Search Artist/Title Catalog link 225, a Print Spine Label(s) link 226, and a Search My Collection link 228. Selection of any one of these individual links presents the user with at least one web page formatted to guide the user through the requested process as will be explained in detail below.

For example, selection of the "List my CDs" link 214 presents the user with a CD table listing web page 229 (FIG. 18) including a categorical listing of those CD titles 60 that have been saved under the user's identification in the user's library stored in the database 58. The CD table 229 is arranged in a columnar format with several headings aligned across the top of the web page such as CD Number 230, CD type 232, CD Category 234, CD Artist 236, CD Name 237, CD length 238, and a Print CD heading 240 positioned above a number of print icons 239 positioned across from each CD title 60.

Figure 18:
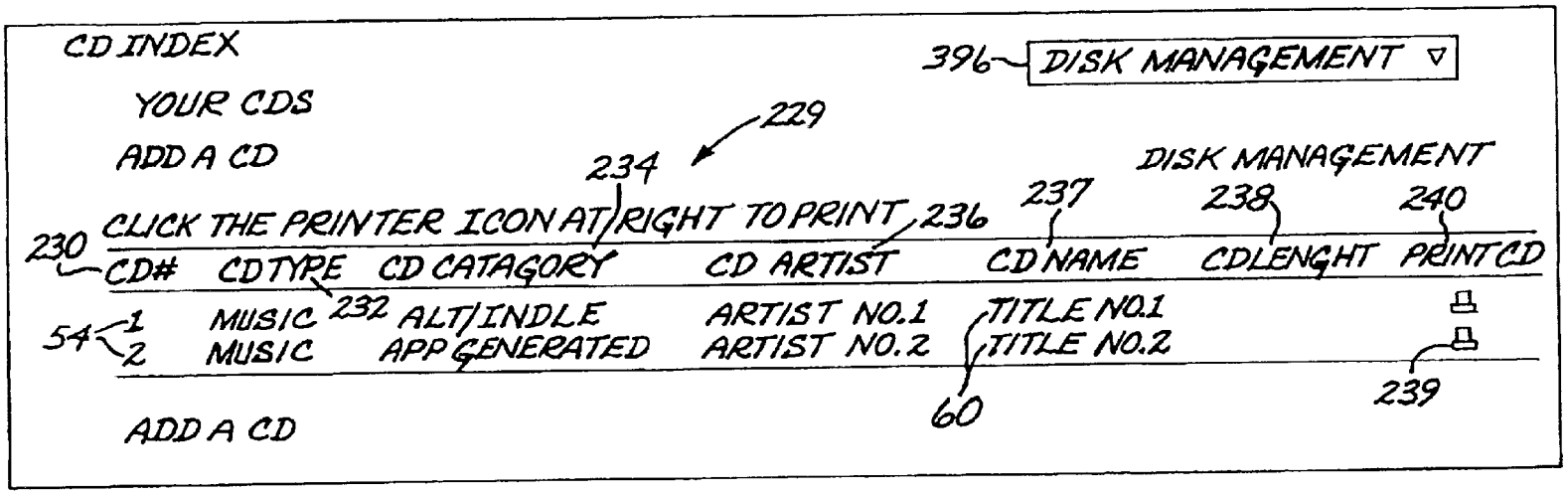
FIG. 18 is an exemplary CD listing web page of the present disc management system.

With continued reference to FIG. 18, information corresponding to each heading on the CD listing 229 is placed in rows beneath the applicable heading. Data entered under the CD # 230 heading provides the positional identifier 54 corresponding to the location of a CD 50 in the binder 42 or a CD changer 292 (FIG. 15) or may merely provide a numeric identifier for otherwise organizing the CD collection. The CD type field 232 includes music, data, software, CD ROM, or DVD. The CD category 234 includes the type of information stored on the compact disc. Exemplary categories are selected from Alt/Indie, Big Band, Blues, Celtic, Christian, Classical, Comedy, Country, Grunge, Heavy Metal, Hip Hop, House, Industrial, Jazz, Kids/Family, Latin, Mood Music, New Age, New Wave, Opera, Pop, Punk, R&B, Rap, Reggae, Rock, Singles, Ska, Soundtracks, Southern Rock, Spoken Word, Swing, Techno, Unplugged/Acoustic, Vocal/Nostalgia, and Unplugged. The CD length 238 refers to sum of the length of all the tracks on the associated CD 50. The CD Artist 236 and CD Name 237 categories are those taken from the CD itself or created by the user if desired. The print icon 241 provides a link to a pop up print window 242, as exemplified in FIG. 20, displaying the selected CD title 60 and its associated tracks 62 for printing in a format for placement in any one of the looseleaf CD pages pockets 46.

Figure 20:
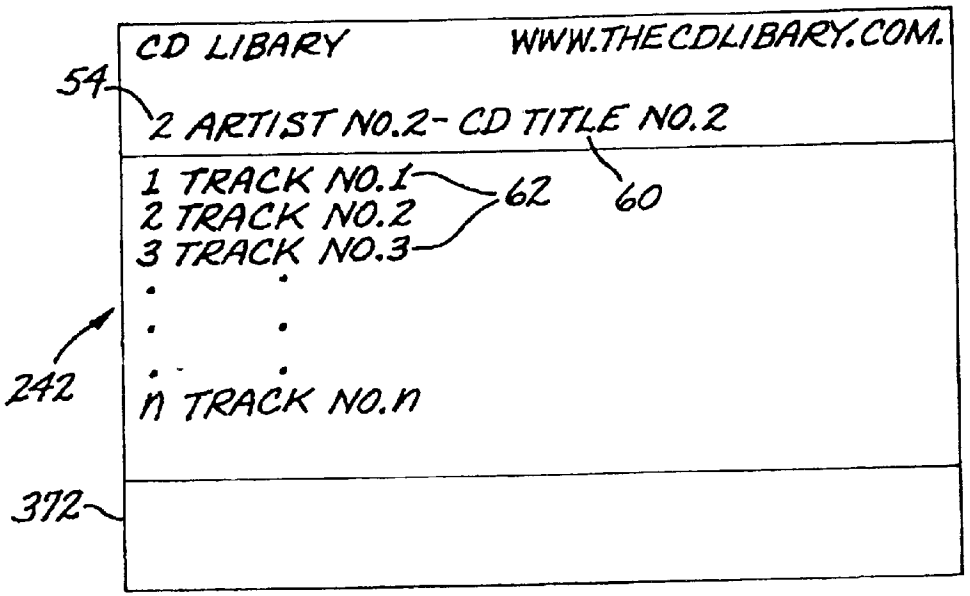
FIG. 20 is an exemplary track listing pop up window of the present disc management system.
Figure 21:
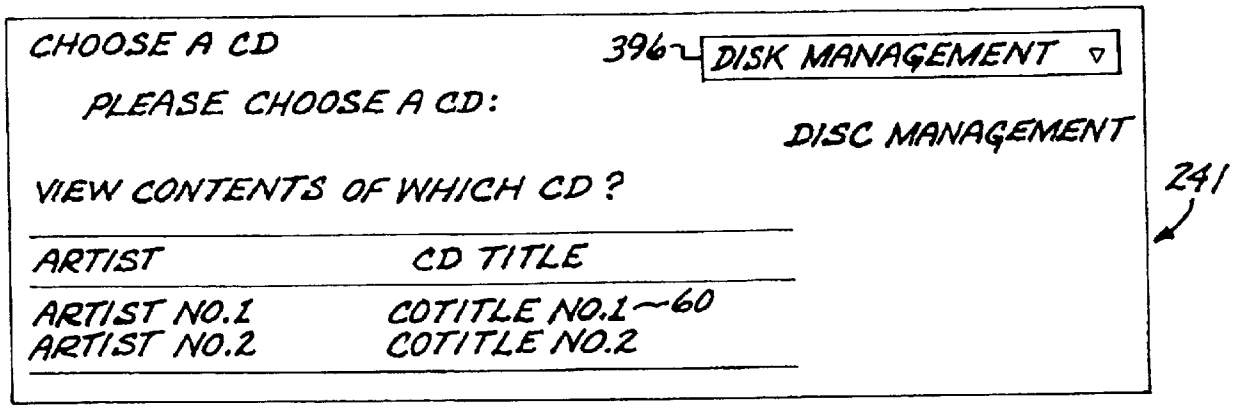
FIGS. 21–22 are exemplary interactive web pages for listing track information associated with CD titles maintained in the database of the present disc management system.

Several other options are provided via web pages as illustrated in FIGS. 17–34 for displaying or printing the contents of a compact disc 50 such as the corresponding track information 62. A user selection of the link "List Tracks on a CD" 220 from the Disc Management Tool page 213 (FIG. 17) presents the user with an exemplary CD title listing web page 241 as illustrated in FIG. 21. Such web page lists all the compact disc titles 60 stored in the disc management database 58 for the individual user according to the CD titles linked to the unique userid entered in the username field 208. Each of the CD titles 60 is selectable and linked in the database 58 to its respective tracks 62. A related track listing web page 243 (FIG. 22) is displayed whenever a title link 60 is selected. The track listing page 243 displays a listing under the headings Track # 244, Track Artist 246, a selectable Track Title 248, Track Classification 250 and Track Length 252 arranged in a columnar format.

While the user may be able to take advantage of the automatic CD title and track update features online as will be described below in many instances, in those situations where a CD title 60 or associated track is not available online, the user may access additional web pages and add such information which then becomes part of the database 58 for others to use. For example, the Add a CD link 216 will bring up a CD addition menu 254 (FIG. 23) having several fill-in areas including a CD Number field 256 and a CD name or identifier field 258. In practice, a CD number and a CD Name entered in their respective fields are the minimum data required to generate the table of contents 64 for quick reference. The disk management application 142 is programmed to automatically generates the next highest number in the series in the CD number field 256 thus saving the user entry time and keeping an ascending order to the CD collection. It will be appreciated that this CD number entered into the CD number field 256 is preferably used as the identifier 54 for keeping track of the position of the associated CD title 60 and related CD 50 within the collection. The CD number 54 may also be edited by manually typing in the data.

Figure 23:
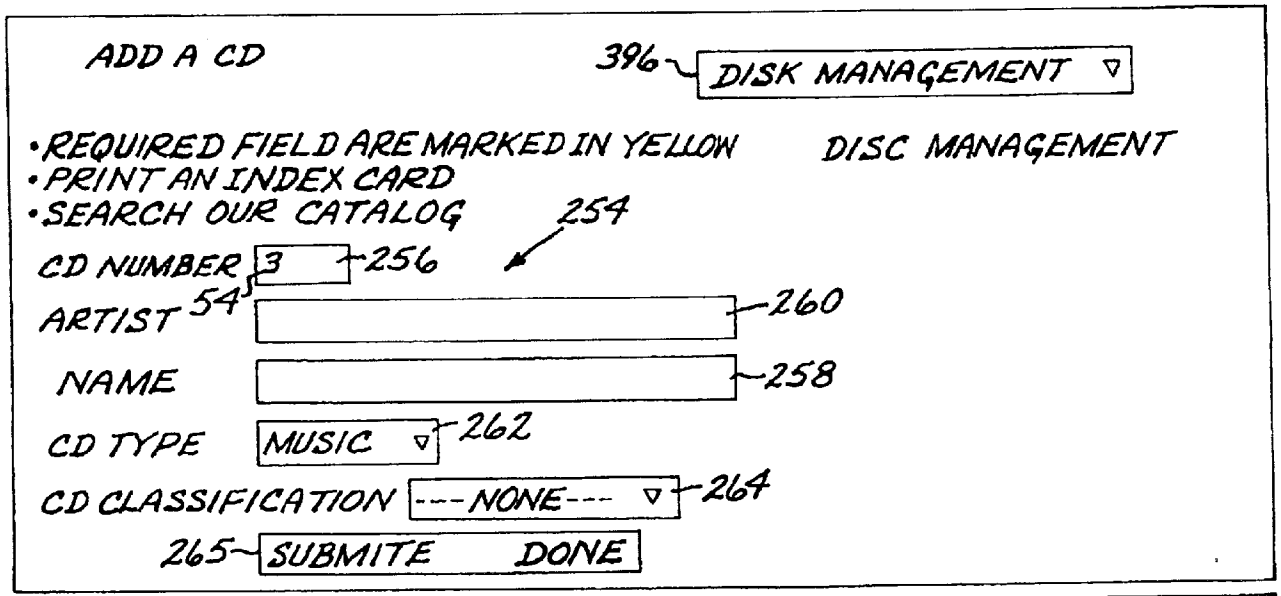
FIG. 23 is an exemplary interactive web page for adding CD information to the present disc management system.

With continued reference to FIG. 23, further categorization of the CD collection is provided through additional searchable fields including an Artist field 260, a CD type pull down menu 262, and a CD classification pull down menu 264. Inputs to each field or pull down menu 260, 262, and 264 provide additional information as to a particular CD title 60. The artist field 260 is for receipt of the Artist's name data. The CD type pull down 262 allows a user to select the type of data associated with the CD type heading 232 (FIG. 18) while the CD classification pull down menu 264 is for receipt of data found under the CD classification heading 234 also identified in FIG. 18. Filling out the fields and selecting options in the pull down menus in the CD Addition Menu 254 and then selecting the submission button 265 transmits the data from the user's computer 130 to the web host processor 140 for processing to link the identifier (CD Number) with the CD title 60 in the database 58 for subsequent retrieval.

Figure 17:
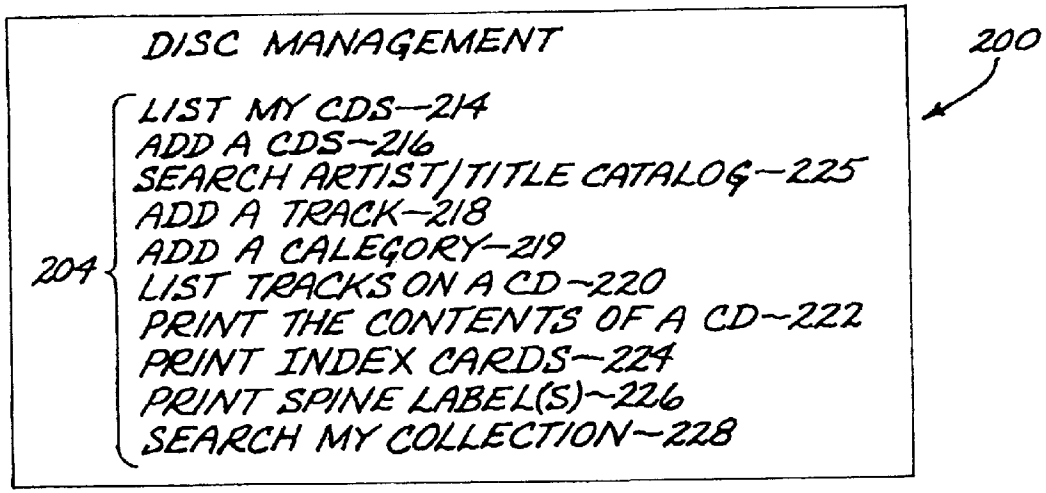
FIG. 17 is an exemplary main disc management tools web page of the present disc management system.
Figure 24:
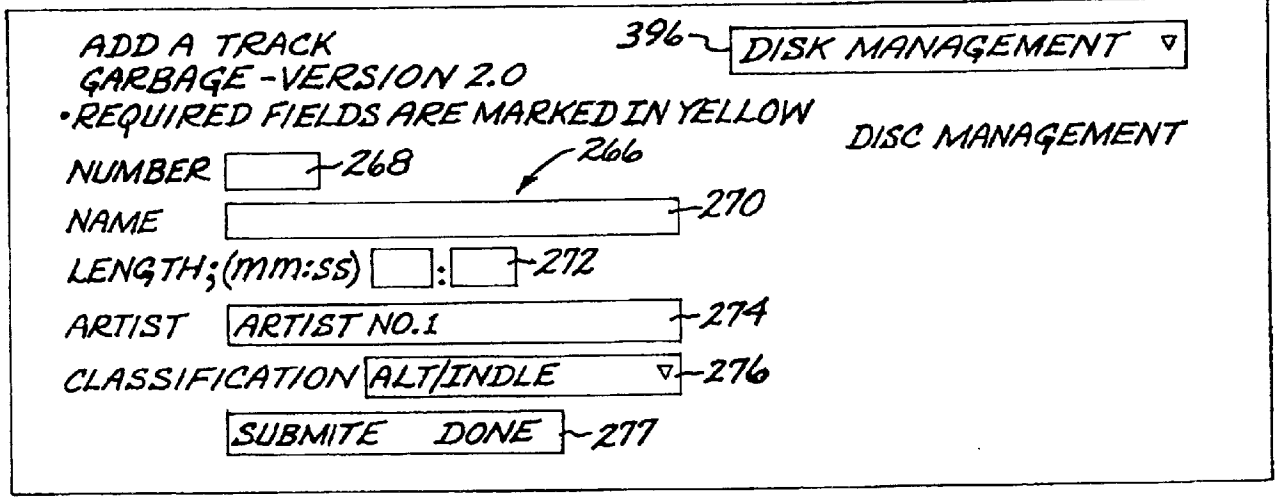
FIG. 24 is an exemplary interactive web page for adding track information to the present disc management system.

Referring now to FIGS. 17, 21 and 24, if the user desires to add a track information 62 such as track title associated with a CD title 60, selection of the Add a Track link 218 from Disc Management Tools menu 204 will present the user with a Choose a CD menu formatted similar to CD title listing web page 241 as illustrated in FIG. 21 providing a list of selectable CD titles 60 previously stored in the database 58. In this instance, however, the CD titles 60 are selectable links for submitting a request to the web host computer 140 for downloading and display of an Add a Track menu 266 as exemplified in FIG. 24. The Add a Track menu 266 includes a track number field 268, a track name field 270, a track length entry field 272, a track artist field 274, and a track classification pull down menu 276 for receiving the corresponding data for entry into the database 58. A data submission button 277 is provided for sending the inputted track data 62 to the web host computer 140 for processing and storage in the database 58 once entry is completed.

Figure 19:
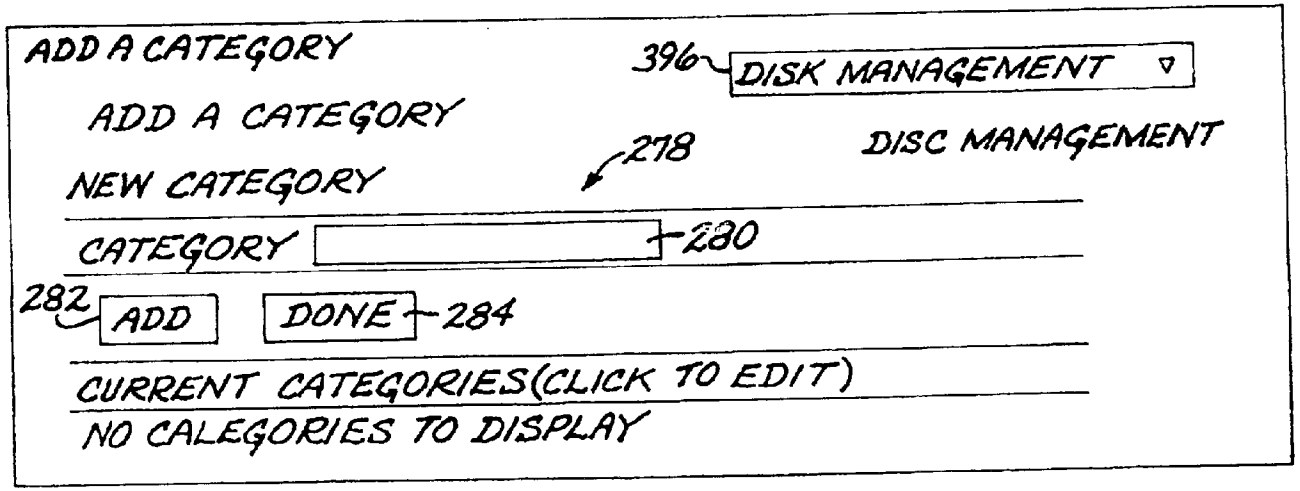
FIG. 19 is an exemplary interactive web page for adding a category to the present disc management system.

Another advantageous option is established using the Add A Category link 219 selectable from the Disc Management Tools menu 204 (FIG. 17). An exemplary Add a Category web page 279 is illustrated in FIG. 19 and includes an add a category menu 278 formatted with a category entry field 280 and an addition button 282. If a particular music category is not available from the category pull down menu 264 on menu 254 (FIG. 23), it may be entered into this Add a Category menu 278 and submitted to the web host processor 140 for storage in the database 58 where it will appear in the category pull down menu 264 during the next retrieval session.

Figure 25:
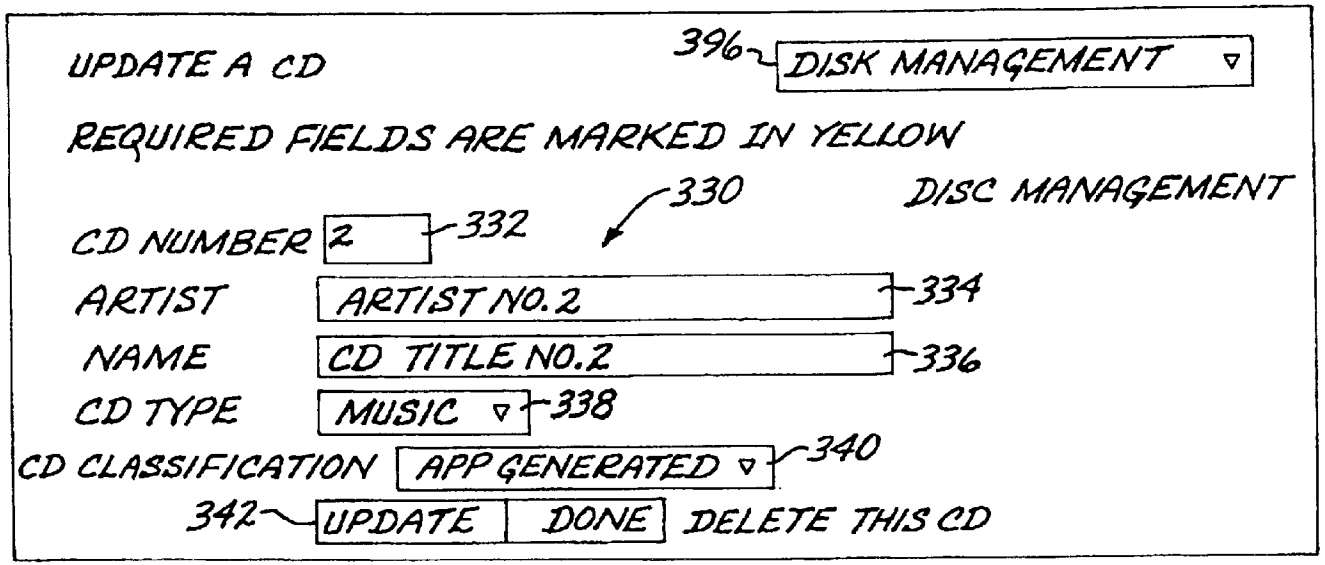
FIG. 25 is an exemplary interactive web page for updating CD information maintained in the database provided in the present disc management system.

Referring now to FIGS. 18 and 25, those CD titles 60 listed under the CD Name heading 237 in the CD listing web page 229 are selectable for editing purposes. Selection of a desired CD title 60 will bring up the Update a CD menu 330 (FIG. 25). Each of the text entry fields having headings CD Number 256, CD Artist 260, and CD Name 258 may be edited by manually typing in the desired text. The user may also elect to select a different CD types using the CD type pull down menu 338 or change CD classification by using the CD classification pull down menu 340. An update button 342 is provided for selection once all desired data has been edited to transmit the edited data the web host processor 140 to update the database 58.

Figure 22:
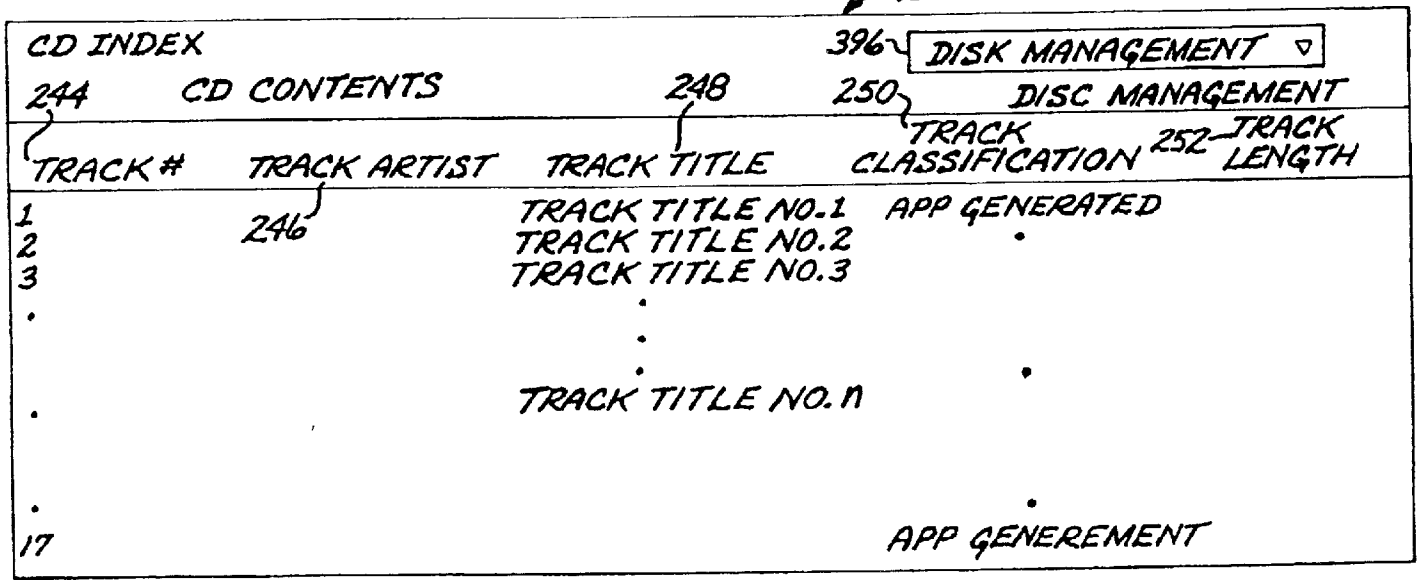
Figure 26:
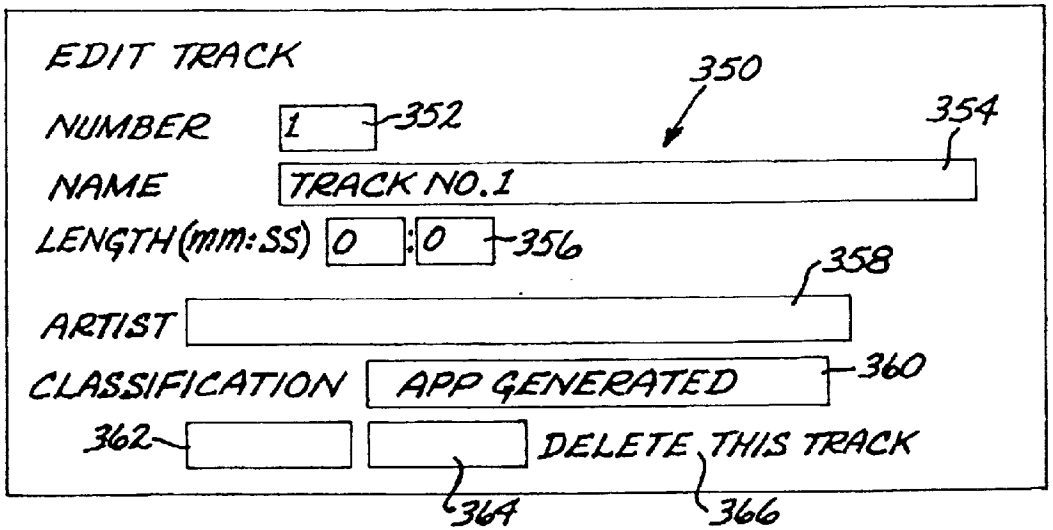
FIG. 26 is an exemplary interactive web page for updating track information maintained in the database provided in the present disc management system.
Figure 27:
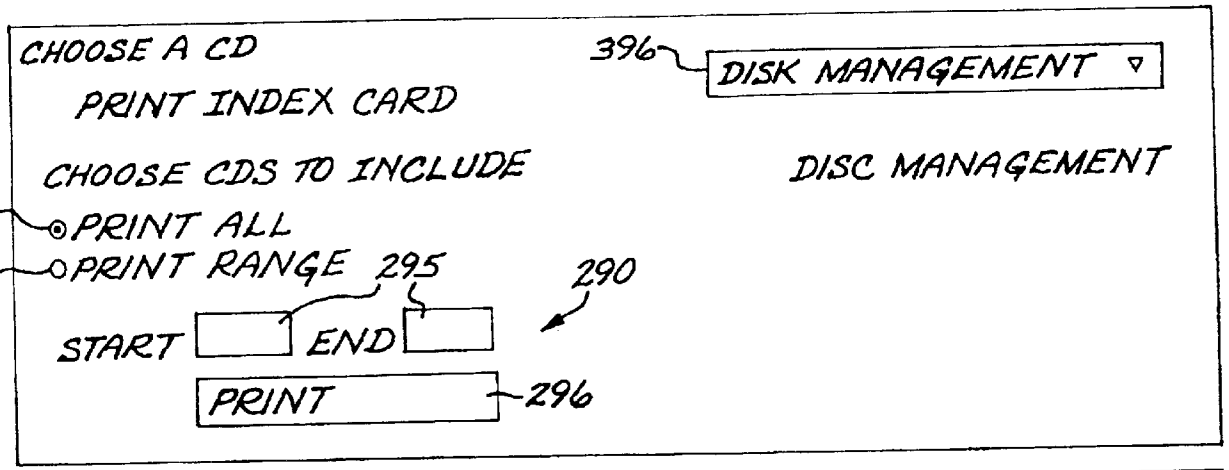
FIG. 27 in an exemplary menu for generating a CD index illustrated in FIG. 14.
Figure 28:
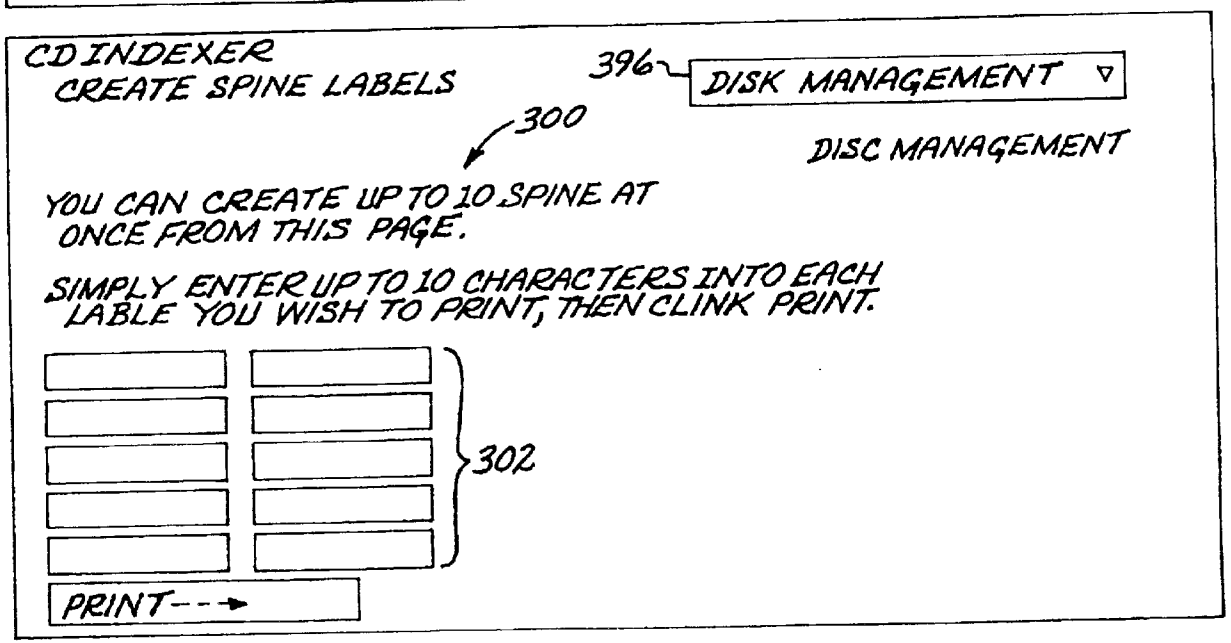
FIG. 28 is an exemplary menu for printing spine labels for the present disc management system.
Figure 29:
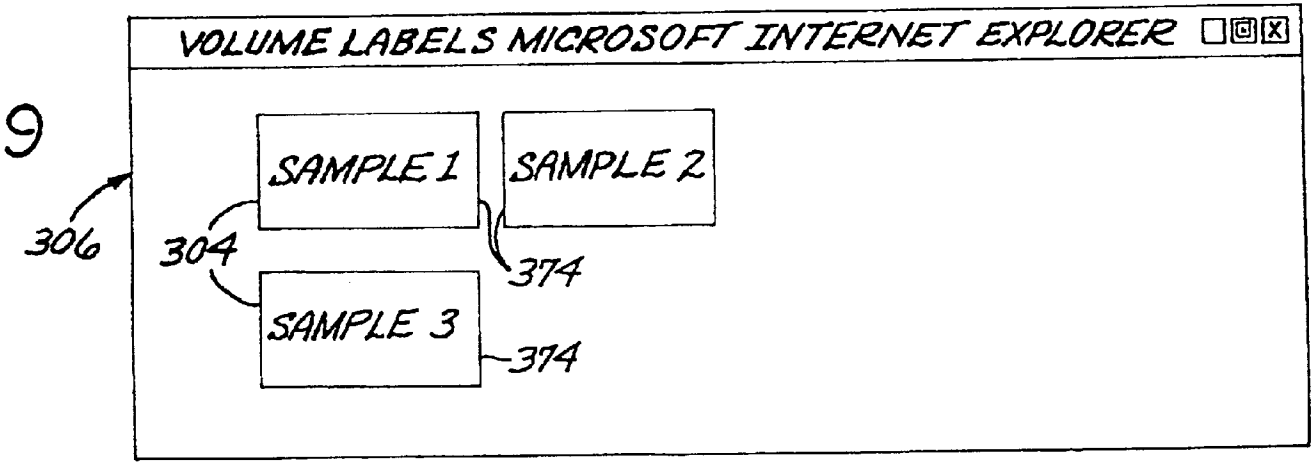
FIG. 29 is an exemplary pop up menu illustrating spine labels ready for printing.

In a similar manner, referring now to FIGS. 22 and 26, track information 62 for a particular track may be edited by selecting the desired selectable track titles 248 in the track listing menu 243 to bring up for display an editable update track menu 350 including text entry fields for Track Number 352, Track Name 354, Track length 356, and Track Artist 358. Each of these field may be edited by placing the desired text in the entry field. A Classification pull down menu 360 is also provided if the user elects to alter the track's classification. An update button 362, when selected, transmits the edited information to the web host processor 140 to update the database 58. Selection of a Cancel button 364 will terminate the editing function without updating the database 58. The track information 62 may also be erased from the database if the user selects the Delete button 366.

Figure 14:
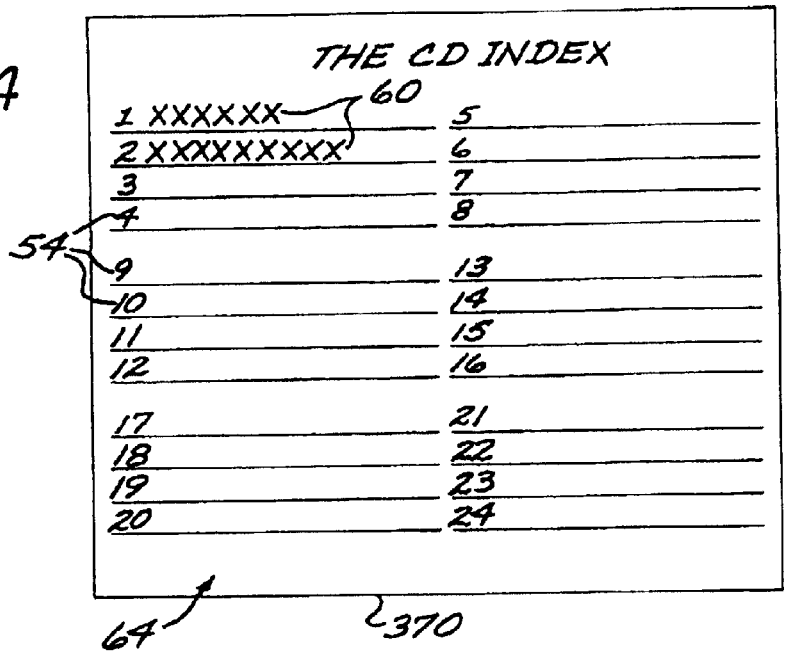
FIG. 14 is a expanded view of circle 14—14 taken from FIG. 15 illustrating an exemplary CD index of the present disc management system.

Referring now to FIGS. 14–15, 17, and 27, the Print my CD collection link 224 on the tools web page 200 links to a print collection menu 290 for creating CD indices 64. The print collection menu 290 includes a Print all selector 291 for printing the entire collection or a second option 293 for selecting a range of CD titles 60 and inputting the range in a pair of range input windows 295. A print submission button 297 is also provided and will generate a pop up window displaying a print preview of a CD index or table of contents 64 as illustrated in FIG. 14 in a prearranged format having a vertical arrangement of CD titles 60 positioned adjacent their respective positional identifiers 54 and further including a printed border 370 sized to fit within one of the viewing pockets 46 of a storage page 44.

In a similar manner, the track listing 62 of a particular CD 50 may be generated by requesting the CD listing web page 229 (FIG. 18) using the Print the Contents of a CD link 222 on the disk management main page 200. Selection of this link 222 results in a listing of CD titles 60 with print icons 239 positioned in a linear arrangement and proximate thereto. Upon selection of the print icon 239 associated with the desired CD title 60, the user is presented with a pop up window 242 of FIG. 20. The contents of the pop up window 242 include a positional identifier 54, a CD title 60, and the associated track information 62 such as a track listing. A track listing border 372 is provided and sized for insertion into a viewing pocket 46 after the track listing 242 is printed out and cut around the border 372.

Advantageously, another organizational tool is accessible through the Disc Management Tool menu 204 upon selecting the Print Spine Labels link 226 (FIG. 17). Selection of the Print Spine Labels link 226 transmits a request to the web host processor 140 to transmit the Create Spine Labels menu 300 as exemplified in FIG. 28 to the user's display terminal 136. The Create Spine Labels menu 300 includes a number of text entry fields, generally designated 302 for receipt of Spine title indicia for printout on a spine label 304 as exemplified in the pop up window 306 of FIG. 29. Such labels may be print out and cut around the borders 374 to size the label for insertion into the open end of spine label sleeve 310 (FIG. 1). Suitable preformatted labels may also be used.

In order to facilitate quick retrieval of a particular CD title 60 or track 62 in either the user's library associated with the user's unique userid 208, the present invention also incorporates a search engine responsive to search data entered into a search menu 312 (FIG. 30) accessible through the Search link 228 in the Disc Management Tool menu 204 (FIG. 17). The search menu 312 includes an Artist entry field 314, a Title entry field 316, a Classification pull down menu 317 including classifications listed above and any new classifications created by the user and stored in the database 58. CD and track selectors 318 and 320 respectively provide a selection area for the type of data sought and are used as a parameter by the search engine to narrow the focus of the search. A search activation button 322 initiates the search process after the data is entered. A sample search listing result 324 is illustrated in FIG. 31 and includes all available information in the database 58 matching the search criteria entered in the search menu 312.

Figure 32:
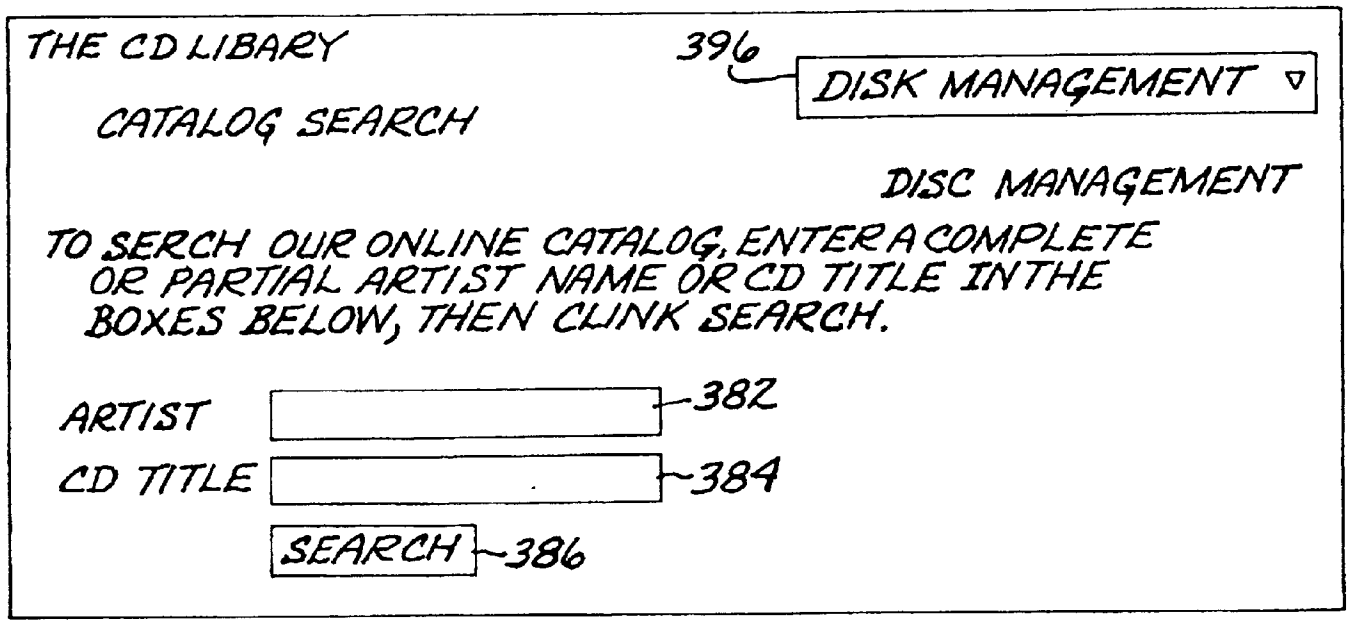
FIG. 32 is an exemplary search catalog library menu provided in the present disc management system.
Figure 33:
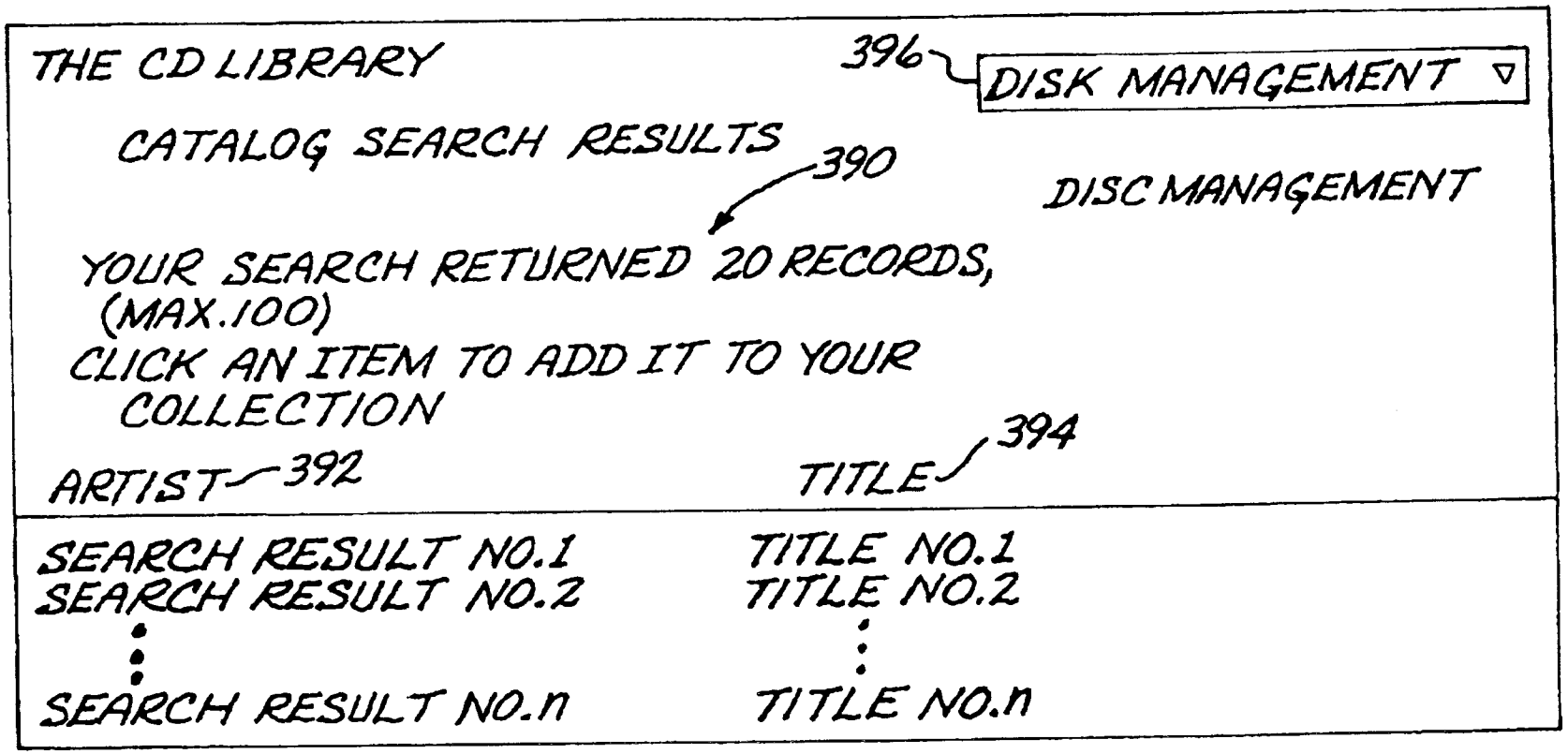
FIG. 33 is an exemplary search catalog results listing.

Because each user also contributes to the overall database 58 in addition to their own user library segment of the central database 58, the search engine is advantageously programmed to be driven by search criteria entered into search catalog menu 380 including text entry fields for artist name 382 and CD title 384 (FIG. 32). A search button 386 initiates the process once the desired search criteria have been entered. An exemplary search catalog results listing 390 is illustrated in FIG. 33 with a dual column format including data listed under an Artist heading 392 and a CD title heading 394 representing all those artist and/titles matching the search catalog criteria.

Figure 34:
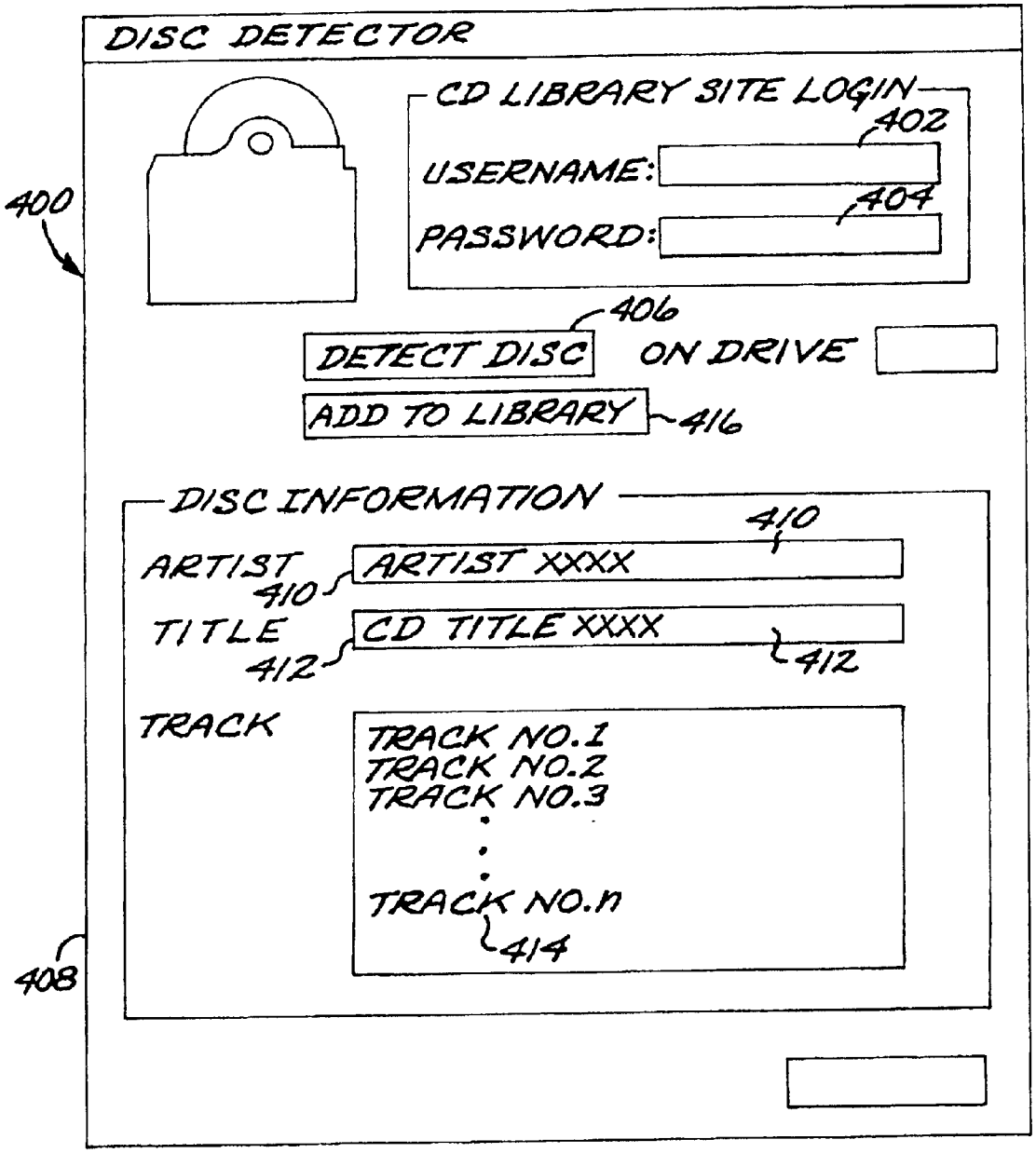
FIG. 34 is an exemplary disk detector interface provided in the present disc management system.

Yet another advantageous feature is provided to save the user from manually entering a significant amount of data by using the disk detector routine 143 in the disk management application 142. Referring now to FIG. 34, a disk detector interface 330 accessible from an icon (not shown) on a conventional desktop environment or alternatively as a link in the disk management tools menu 204. Such interface may be used independently of the main web site to acquire information for adding to the database 58. The disk detector interface includes a username text entry field 402 and a password text entry field 404 for receiving login data from the user. A detect disc button 406 allows the user to initiate the disk detection routine 143 after a CD has been placed in a compatible drive in communication with the disk management system 40. Results retrieved by the routine are displayed in the disc information section 408 which includes an artist field 410, a CD title field 412, and an associated track listing field 414. An Add to Library button 416 positioned beneath the Detect Disc button 406 is used to initiate the process of updating the user's library in the database 58 with the detected disk information 408.

Figure 15:
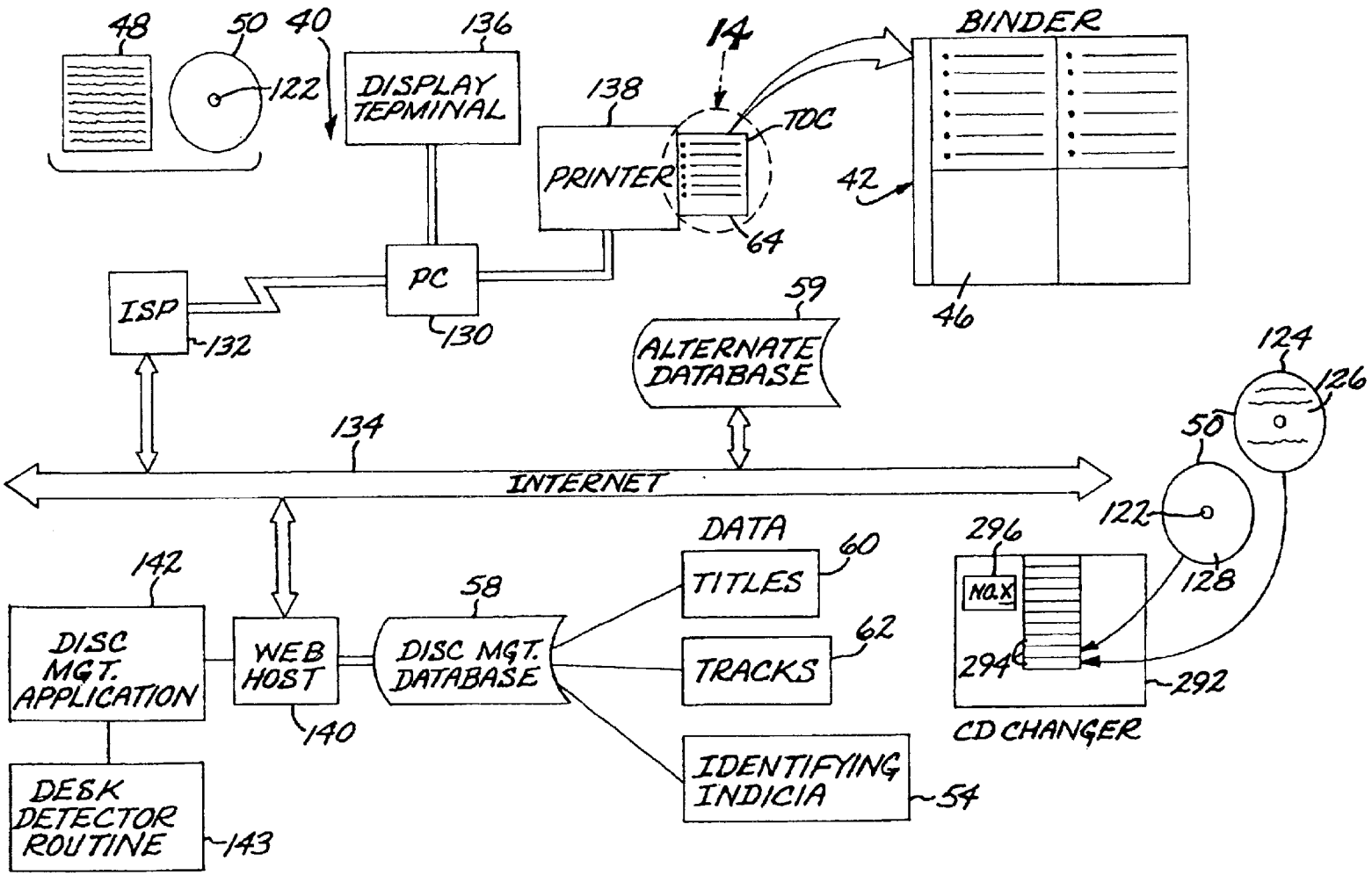
FIG. 15 is a schematic view of a preferred embodiment of the present disc management system invention.

Referring now to FIG. 15, while not an essential component of the disc management system 40, it has been found that the present invention works well in conjunction with a conventional CD changer 292. Such changer typically includes slots 294 for each compact disc 50 ranging from 100–400 in number. The slots are typically numbered in ascending order. A display 296 on the outer facing of the CD changer also indicates the present disc being accessed and its position. By linking the associated indicia 52 identifier in each viewing pocket 46 in the display binder 42, a quick reference tool is provided wherein the user may open the binder to the table of contents 64 and scan the list until the CD title 50 being sought is located. The associated indicia 52 positioned directly to the left of the CD title 50 is then read and the user is then informed which slot 294 in the CD changer that the CD 60 bearing that looked up title 50 is located as well as what viewing pocket 46 any associated liner notes 48 or track listing 286 are located in.

Operation of the Disc Management System

For purposes of illustration, it will be assumed that a user having a number of compact discs for use with a CD changer desires to organize the set of CDs and desires to use a web site such as that provided at www.thecdlibrary.com to guide the user through the CD index creation process. It will be understood that the interaction between the user and the active server pages provided at the web site are accomplished using conventional browsing techniques.

While the following example is primarily directed at compact discs having musical content, it will be understood that the present invention is not restricted in this manner and that the organization of compact discs having any type of contents such as software applications, multimedia, raw data, video, or any other information capable of being stored on an optical disc shall benefit from the present invention and be accommodated thereby. A detailed description of an exemplary process follows.

Referring now to FIGS. 15–34, a CD collector or disc management system user selects a group of CDs 50 to be organized. The selected CDs 50 are removed from their jewel cases (not shown) along with their associated liner notes 48. The web host processor 140 of the disc management system 40 which is in communication with the Internet 134 is accessed from a terminal 136 via a personal computer 130 in communication with an internet service provider 132 or other online service using suitable hardware and software communications. The main tools page 200 (FIG. 17) is requested using conventional browsing techniques.

For security reasons, initially the disc management tools 204 are inactive and thus the collector must select any of the disk management tools 204 to bring up the sign in web page 206 (FIG. 16). Upon accessing the sign in web page 206, the user enters the requested username and password in the respective provided fields 208 and 210 and selects the submission button 212 to transmit the username and password to the web host computer 140 for processing to determine if the username and password membership data are correct. A successful login results in the return of the main tools page 200 (FIG. 17) along with the disc management tool links 204 being transmitted to the collector's terminal 136 and enables the collector to access the disc management database 58 and routines provided by the disk management application 142 maintained on the web host processor 140 by selecting the appropriate disc management tool link 204. The user is now capable of reading from the entire database 58 and also adding to, editing, or deleting from a subset of the database 58 reserved for and associated with the user's unique userid 208.

More specifically, and assuming the collector has no CD titles 60 or track information 62 previously saved in the database 58, the collector selects the Add a CD link 216 (FIG. 17) to bring up the CD addition menu 254 (FIG. 23). The CD 50 is then inserted into the desired slot 294 of the CD changer 292 (FIG. 15). In this example, it will be assumed that the CDs 50 are placed into the CD changer slots 294 in ascending numerical order. The CD number of the desired CD slot 294 is input by the user into the CD number field 256 of the CD Addition menu 254, if not automatically generated by the disk management program 142. The CD title 60 is then typed into the CD name field 258. As the number of the CD changer slot 294 is unique to the CD location, the number entered to the CD number field 256 provides a unique positional identifier 54 for the CD which is used for the creation of the CD index 64 as will be explained below. The input of the CD number 256 and CD title 60 is sufficient amount of information from which to create the CD index 64.

With continued reference to FIG. 23, if desired at this time, additional information concerning the CD 50 may be entered. For instance, the collector or user may also enter an artist name in the artist field 260 and also select the CD type pull down window 262 to see a list of available selectable CD types and select one by highlighting the selection as is well known to those familiar with a conventional computer display interface. In this example, the user would select the CD type "music" indicating the CD contains musical content. A CD classification may also be entered by selecting the CD classification pull down menu 264 and selecting one of the classification options as described herein. After all the information about the particular CD 50 is entered, the user then selects the submission button 265 to transmit the information from the user's computer 130 to the web host processor 140 where the data is processed and stored in the centralized database 58 in association with the user's unique userid 208 for subsequent retrieval.

The collector then repeats this process for all CDs 50 to be organized by going through a process of selecting a CD 50 and placing it in a unique CD changer slot 294 noting the position identifier 296 in the CD changer 292 (FIG. 15). The CD title 60 and the slots position 296 are entered into the Disc Management system database 58 in the respective CD Name fields 258 and CD number fields 256 to compile a user library of all of the CD titles 60 and positional identifiers 54 to be organized.

In conjunction with the placement of the CDs 50 into the CD changer, referring now to FIGS. 1–2, 10, and 12, the respective liner notes 48 associated with each CD 50 are inserted into the window pockets 46 having an associated indicia 52 matching the position identifier 54. Preferably, the first display page 44 in the binder 42 or other designated portion of the binder such as front cover or rear sliding panel (not shown) is left empty for receipt of the CD indices 64. At this point, all CDs 50 to be organized are located in a particular slot 294 in the CD changer 292, the desired information about each CD has been entered and stored in the database 58 including a CD title 60 and a positional identifier 54, and the liner notes 48 are inserted within the correspondingly identified viewing pocket 46 having matching indicia 52 in the binder 42. It remains to create a table of contents 64 or index card for the binder 42 to provide a quick and convenient reference chart as to the location of each CD.

Referring now to FIGS. 14–15, 17 and 27, to create the table of contents 64 for the entire collection the user requests the disc management web page 200. Preferably, each web page contains a direct link 396 each of the other pages including the active disk management web page 200 for quick access to the disk management tools 204. Upon accessing the disk management web page 200, the user selects the Print my CD Collection link 224 from the disc management tools 204 to request the Print my CD Collection menu 290 illustrated in FIG. 27. The web host processor 140 receives the request and transmits the Print my CD Collection menu 290 to the user's computer 130 for display on the user's display terminal 136. For a quick printout of all CD titles 60 and positional identifiers 54 associated with the user's unique userid 208 stored in the database 58, the user merely selects the print all selector 291 and then selects the print button 297. The print CD collection request is transmitted from the user's computer 130 to the web host computer 140 where it is processed by the disk management application 142. The disk management application 142 accesses the database 58 and retrieves all CD titles 60 and their associates positional identifiers 54 and then formats them in a listing in ascending numerical order with a border 370 as exemplified in the CD index 64 illustrated in FIG. 14 which the user prints out with the printer 138. The border 370 is sized such that the user may cutout the CD index 64 along the border and slide the cutout index 64 into one of the viewing pockets 46 in the first page 44 of the binder 42 (FIGS. 1 and 15). Preferably, twenty to thirty titles per CD index 64 are printed out. If more titles are required then additional CD indices 64 are printed. Thus if the user inserts CD indices 64 in each of the eight pockets on the front and back of the first page 44 of the binder, up to 240 titles can generally be accommodated. However, these numbers are not meant to be limiting and it will be appreciated that more indices can be created and the user may conveniently add more display pages 44 in the binder to accommodate a larger CD collection.

Referring back to FIG. 27, if the collector desires to print out less than the entire user library from the database 58, the user selects the print range selector 293 and inputs a low end and high end of the desired range in the range windows 295. Selecting the print submission button 297 will then process the print request and create a CD index 64 with CD titles 60 and positional identifiers matching the requested range.

Once the table of contents 64 have been inserted into the binder 42 (FIGS. 1 and 15), it will be appreciated that a user-friendly disc management system 40 is available for use by the collector. If the collector desires to play a particular CD 50, it is a simple matter to open the binder 42 by grasping the front cover 76 and quickly scan the viewing windows 46 on the first page 44 of the binder to locate the desired CD title 60. Once the desired title 60 is located in a matter of moments, the user views the positional identifier 54 located to the left of the selected CD title 60 (FIG. 14). This positional identifier 54 informs the user that the desired CD is located in that particular slot 294 in the CD changer 292 (FIG. 15) and further informs the user that any other content associated with the CD 50 such as the liner notes 48 have been inserted into the viewing pocket 46 with an associated indicia 52 matching the positional identifier 54. The user may simply grasp the edges of the pages 44 and leaf through the binder until locating the desired viewing window 46. As the associated indicia 52 on the viewing windows are in ascending order as well, it is a relatively simple matter to directly turn to the desired viewing window. The user may then view the liner notes 48 directly through the front transparent panel of the viewing pocket 46 or withdraw the liner notes 48 and review them out of the binder 42. Typically, the liner notes include track listings 62 such as song titles and length of song. Thus, the user may select the desired slot 294 in the CD changer 292 and further select a particular track on the CD 50 for immediate play. Selecting a CD title 60, viewing the positional identifier 54, and reviewing the liner notes 48 in preparation for playing a CD in the changer may all be repeated as desired.

It will be appreciated that such system also greatly facilitates the creation of a play list on the changer 292. In other words, the user may desire to select a number of CDs 50 to be played in some order or randomly in the changer. By viewing the positional identifier 54 of a number of CD titles 60 on the CD indices 64, the user may simply enter the desired CD slots 294 into the CD changers memory to play a number of CDs using conventional CD programming techniques.

Referring to FIG. 17, another organizing routine is initiated by selecting the print spine labels link 226 within the disk management tools 204 section. After the user selects this link, a spine label editing menu 300 with text entry fields 302 is presented on the user's display terminal 136. The user then enters in the desired text descriptive of a particular binder's 42 contents and selects the print button 303. A preview pop up spine label window 306 will appear on the user's screen 136 with the label text and border 374 and, if acceptable, may be printed out on a label sheet or suitable paper. The desired label is then cut out around the border and inserted in the spine label sleeve 310 on the spine 70 of the binder. Such feature is particularly advantageous if a number of binders are being used to organize the CD collection.

While such disk management system 40 greatly facilitates the creation of a CD index 64 or indices for organizing a user's CD collection, several other features of the present disk management system significantly enhance its user-friendly character by providing keyless entry of the CD related information such as the CD title. The first feature is the incorporation of prestored CD related information in the centralized database 58. As more and more users subscribe to the disc management system 40 online service, the overall database 58 will continue to add more and more CD title listings. Thus, although one user's unique library of CD titles 60 stored in the database 58 under the user's unique username contains one set of CD titles, the overall database will include many other CD titles. To take advantage of the overall collection and save time keying in a CD title manually, the user may invoke a search engine by selecting the Search Catalog link 225 from the disk management tools 204 on the disk management main page 200 (FIG. 17). Selection of the search catalog link 225 activates a search routine which is initiated through data entry in the search menu 380 (FIG. 32). The user enters a keyword in the Artist field 382 or a CD title field 384 and further selects the search button 386. This transmits the keyword to the web host processor 140 where it is processed and provided to the search engine which compares the keyword with the CD titles 60 stored in the overall catalog or library maintained in the database 58 and returns any results in a results listing 390 Each of the CD titles 60 provided in the search results listing 324 is conveniently selectable and selecting one will add the CD title to the user's library maintained in the database 58 saving the user from entering duplicative CD titles.

Figure 30:
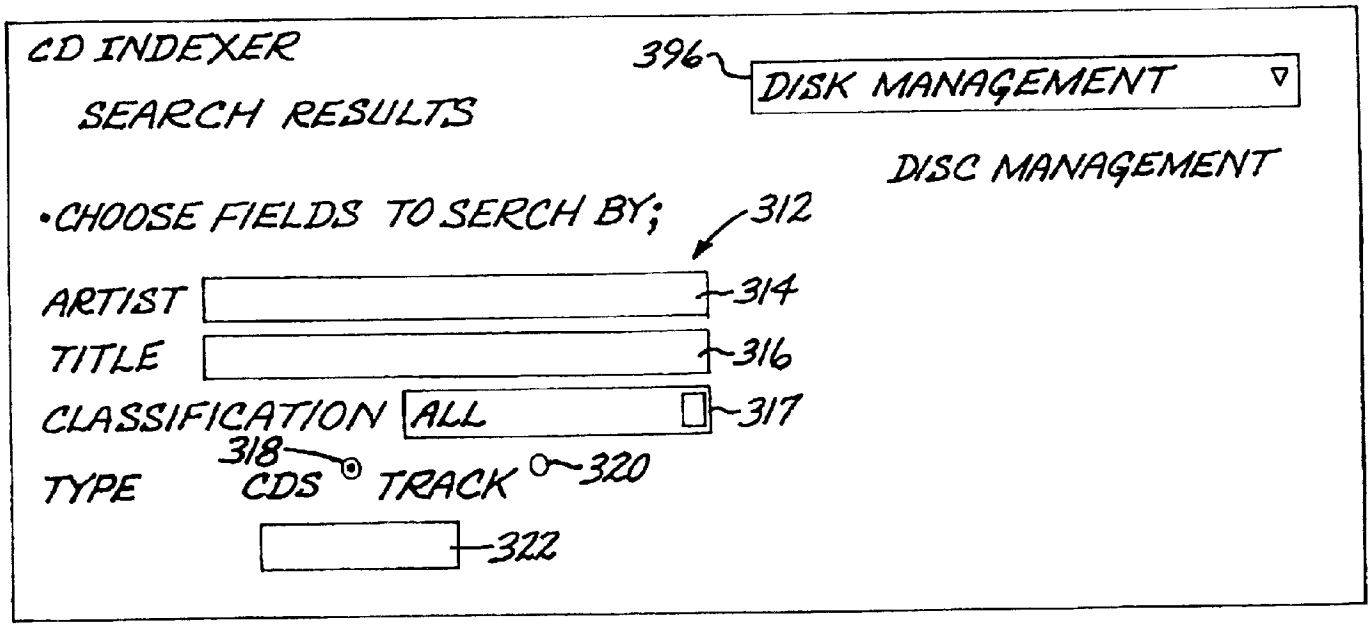
FIG. 30 is an exemplary search user library menu provided in the present disc management system.
Figure 31:
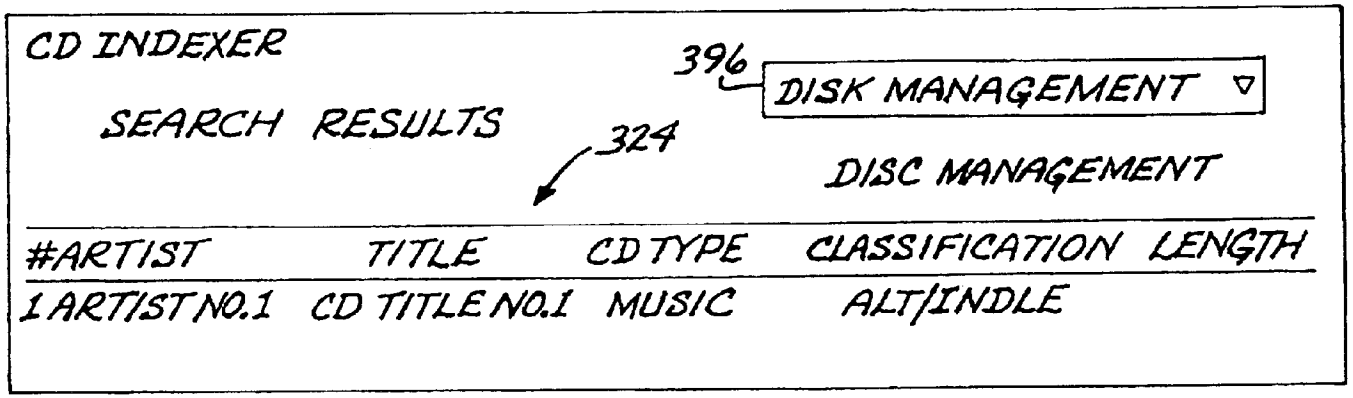
FIG. 31 is an exemplary search user library results listing.

Referring now to FIGS. 30–31, this disk management application 142 is also programmed to enable the user to search his or her own collection within the database 58. This feature is accessible through the search my collection link 229 in the disk management tools menu 200. Selection of the search my collection link 229 results in a search menu 312 popping up on the user's terminal display 136. The user may elect to type in an artist name or a title in their respective fields 314, 316. A classification may be selected from the pull down menu and either the CD selector or track selector is chosen. Once these search criteria are selected, the user selects the search button 322 which transmits the search criteria to the web host processor for processing. The search engine will only search the user's individual library in this scenario and return any results in a search results listing 324 (FIG. 31).

The disk management application 142 may also be programmed to search other searchable databases 59 providing similar information such as that provided by Gracenote.com available at the web site www.gracenote.com which currently advertises over 800,000 albums and over a million song titles.

Another feature providing keyless entry is the incorporation of a disc detector routine 143 run by the disk management application 142 which is accessible through a disk detector link 227 on the disk management tools web page 200 (FIG. 17). The disk detector is available as a downloadable executable file from www.thecdlibrary.com. The user activates the disk detector routine by selecting the disk detector link 227. A disk detector pop up window 400 appears on the user's display terminal 136 to receive entry data including in a username field 402 and password field 404 (FIG. 34). Such detector routine 143 enables the user to place CD 50 into a compatible device such as the CD drive of the user's personal computer 130 and transmit its digital signature to an identifying routine upon selection of a detect disc button 406. The identifying routine searches one of the associated databases 58 or 59 for a CD title 60 matching the digital signature and returns the artist name 410, title name 412, and track listing 414 in the disc information section 408 in the disk detector pop up window 400. If the listing is acceptable to the user, the Add to Library button 416 is selected transmitting the information to the database 58 for storage in the user's unique library. It is then a matter of performing a search along the lines discussed herein for the earlier method of keyless entry to locate and add a title to a CD index 64.

In addition the creation of the CD indices 64, the present disk management system 40 also provides a number of additional features. One such feature is the capability of providing a track listing 242 when, for example, the user loses or misplaces the liner notes 48 associated with a particular CD title 60. Recently, it has also become popular to burn one's own CDs and thus a routine for creating a track listing 242 also accommodates such activity by enabling a user to manually type in track titles stored on the CD or select titles available from a database to generate a track listing therefrom. Referring now to FIGS. 17–18 and 20, the user selects the List Track on a CD link 220 from disc management tools section 204 on the main disk management web page 200. This selection brings up a listing of the user's CD titles 60 from the database 58 on the user's terminal 136. By selecting a print icon 239 adjacent a desired CD title 60 from the listing, the user submits a request for a track listing 242 appearing in a pop up window (FIG. 20) listing all tracks associated with the selected CD title 60 offering the user with a preview of the track listing 242. The track listing 242 may then printed using ordinary browser or operating system commands to the user's printer 138. A border 372 is provided around the track listing to guide the user when cutting the track listing to a size for insertion into a viewing pocket 46. Thus, if the user loses the liner notes 48 associated with the CD 60, a track listing 242 may be printed out and inserted into the proper viewing pocket 46 to display the track listing in the form of a convenient index card.

It will be appreciated that the database contents and software application of the present disc management system could be provided on an optical disc 50 itself and sold along with the display binder 42 as an alternative to using an online database. If a selected title is not available on the compact disc, then the table of contents could be supplemented through the adding the new title using the application software and accessing the online database or purchasing an updated database disc. Use of the present system in conjunction with a compact disc database (CDDB®) service provided through Gracenote.com which currently advertises an online compact disc database collection with information on over 800,000 albums and 10 million songs is the preferred means of accessing song titles to save a user from having to type his own titles.

While the present invention has been described herein in terms of a disc management system including a binder and online database manager, various changes and improvements may also be made to the invention without departing from the scope thereof. One such example is that number of pages per binder may be varied and other suitable dimensions may be incorporated. In addition, instead of front viewing panels in the binder, it is also contemplated that a rear panel slid into the back cover with a sleeve for inserting the CD indices 64 could be used.

In practice, it is preferable to accommodate a collector's frequent desire to relocate the compact discs from one location to another such as from a home CD changer to an automobile CD player or portable CD player. Thus, it is also contemplated that such associated indicia may be provided in the form of a duplicate set of stickers ranging from 1–300 or 1–400 or other suitable range to match the capacity of the binder. In use, a collector may place one sticker on a selected viewing pocket and a duplicate sticker on the associated CD itself such that when the CD is returned back to the binder or CD changer it is easily replaced in the desired location.

In addition to organizing optical discs and related materials, it will be appreciated that the present invention described herein is very useful for organizing substantial amounts of collectible materials such as trading cards, photographs, coins, stamps, and any other item having a generally low profile as thus provide a collectibles management system. Material descriptors offering a brief description of each collectible may be used instead of CD titles in the database. Positional identifiers are then assigned to the material descriptors matching the pocket indicia wherein the collectible is stored. The table of contents is generated using the material descriptors and associated positional identifiers and attached to the album or binder. The pocket sizes may be varied to accommodate the various collectibles. For example, viewing pockets having dimensions to accommodate photographs of 4×6, 5×7, or 8×10 may be used. Other suitable dimensions will occur to one of ordinary skill in the art to accommodate additional collectibles. While a preferred organizational approach is to place related materials in the binder, it will be understood that the binder could be sectioned off to store materials in different categories or various collectibles could be placed throughout the binder.

What is claimed is:

1. A display apparatus for displaying and organizing large numbers of compact discs and their respective liner notes for use in conjunction with a compact disc changer having a plurality of slots with associated unique slot identifiers comprising wherein said compact discs are stored, said display apparatus comprising:

an elongated spine member having an upper flange folded to form an upper rearwardly facing retention recess and a lower flange folded to form a lower rearwardly facing retention recess, said flanges being located at opposing longitudinal margins of said spine;

a first cover member including an innermost end having a first flexible hook insertion into said upper retention recess from an external spine side direction, said first cover member including a plurality of display sleeves openable at one end and having an outwardly facing transparent viewing surface;

a second cover member including an innermost end having a second flexible hook inserted into said lower retention recess from an external spine side direction;

said hooks cooperating with said flanges to pivotally attach said cover members to said spine;

a plurality of flexible loose leaf pages having an elongated gutter section positioned between a display section and a perforated hinge section, said display section having at least one side formed with at least one pocket having a non-woven backing and an opposing transparent veiwing window for viewing of said liner notes inserted therein, each of said pockets having a unique indicia correlating the respective said liner notes with the respective said unique slot idenefiers corresponding with the respective said slots in said compact disc changer; and a plurality of detachable post members projecting between said upper flange and said lower flange securing said first and second cover members to said spine and further passing through said perforated hinge section of each of said pages to releasably secure said pages to said spine and whereby said posts may be disconnected and said perforated hinge section of said looseleaf pages may be inserted thereover and said posts reconnected to secure said pages to said spine member between said first and second cover members and each of said liner notes may be inserted into individual said pockets with said unique indicia correlating to the unique slot identifier of said slot in said compact disc changer wherein said compact disc in stored.

2. The display apparatus as set forth in claim 1 wherein:

each said page includes respective front and back sides having a common central divider and said display sections including a 2×2 matrix arrangement of said pockets.

3. The display apparatus as set forth in claim 1 that includes:

twenty-six pages including one of said pages displaying a table of contents and wherein;

said display sections include on their respective front and back sides respective 2×1 matrix arrangement of said pockets for receiving selected materials; and said pages being 7 and ⅞ inches wide and 10 and ⅞ inches tall.

4. The display apparatus as set forth in claim 1 that includes:

twenty-six pages including one of said pages displaying a table of contents and wherein;

said display sections include on their respective front and back sides respective 1×1 matrix arrangement of said pockets for receiving selected materials; and said pages being 7 and ⅞ inches wide and 6 inches tall.

5. The display apparatus as set forth in claim 1 wherein:

said pockets are openable from their respective top sides.

6. The display apparatus as set forth in claim 1 wherein:

said pockets include a thumb notch providing access to a central aperture of a compact disc inserted therein.

7. The display apparatus as set forth in claim 1 wherein:

said posts are formed in quarter inch detachable sections.

8. The disc management system as set forth in claim 1 wherein:

each of said flanges including a flap covering the ends of said posts.

9. The display apparatus as set forth in claim 1 wherein:

said display section of each page includes back to back pockets with a central common divider formed of a non-woven material.

10. The display apparatus as set forth in claim 1 wherein:

said pockets are 5 inches wide by 5 inches high.

11. The display apparatus as set forth in claim 1 wherein:

said gutter section is approximately one inch wide.

12. The display apparatus as set forth in claim 1 that includes:

twenty-six pages including one of said pages dedicated to a table of contents.

13. The display apparatus as set forth in claim 1 wherein:

at least one of said pockets include a table of contents insert listing all compact disc titles having said liner notes stored in said pockets, said listing linking each of said titles to a position of each compact disc in said changer.

14. The display apparatus as set forth in claim 1 wherein:

said pockets are between 2.5 inches to 3.0 inches square.

* * * * *